US012735856B2

(12) United States Patent
Sano et al.

(10) Patent No.: US 12,735,856 B2
(45) Date of Patent: Sep. 15, 2026

(54) SHOVEL

(71) Applicant: SUMITOMO HEAVY INDUSTRIES, LTD., Tokyo (JP)

(72) Inventors: Yusuke Sano, Kanagawa (JP); Chunnan Wu, Kanagawa (JP); Hisashi Osumi, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 3 days.

(21) Appl. No.: 18/973,691

(22) Filed: Dec. 9, 2024

(65) Prior Publication Data

US 2025/0207352 A1 Jun. 26, 2025

(30) Foreign Application Priority Data

Dec. 25, 2023 (JP) ..... 2023-218209

(51) Int. Cl.

| | |
|---|---|
| ***E02F 3/43*** | (2006.01) |
| ***E02F 3/32*** | (2006.01) |
| ***E02F 9/26*** | (2006.01) |
| *E02F 9/22* | (2006.01) |

(52) U.S. Cl.

CPC ..... *E02F 3/437* (2013.01); *E02F 3/32* (2013.01); *E02F 9/26* (2013.01); *E02F 9/2285* (2013.01); *E02F 9/2292* (2013.01); *E02F 9/2296* (2013.01)

(58) Field of Classification Search

None

See application file for complete search history.

(56) References Cited

U.S. PATENT DOCUMENTS

| | | | | |
|---|---|---|---|---|
| 5,908,458 | A * | 6/1999 | Rowe | E02F 3/437 701/50 |
| 11,391,020 | B2 * | 7/2022 | Ishii | E02F 9/261 |
| 2020/0011029 | A1 * | 1/2020 | Sano | E02F 9/265 |
| 2020/0299935 | A1 * | 9/2020 | Izumikawa | E02F 9/2025 |
| 2023/0034265 | A1 * | 2/2023 | Renner | E02F 9/264 |

FOREIGN PATENT DOCUMENTS

| | | | | |
|---|---|---|---|---|
| JP | 2020-165260 | | 10/2020 | |
| WO | WO-2021006349 | A1 * | 1/2021 | E02F 9/264 |

* cited by examiner

*Primary Examiner* — Daniel L Greene

(74) *Attorney, Agent, or Firm* — IPUSA, PLLC

(57) ABSTRACT

A shovel to move an object to predetermined place by repeating a series of operations including an excavation operation and a dumping operation, the shovel including: a lower traveling body; an upper swivel body pivotably mounted on the lower traveling body; an attachment attached to the upper swivel body; a sensor attached to the upper swivel body; and a control device configured to calculate, based on output of the sensor, an excavation reactive force generated by the excavation operation and an excavation weight, which is a weight of object taken into a bucket and moved to the predetermined place. The control device is configured to set a target value related to the excavation reactive force of a second excavation operation subsequently performed one or more times, based on a relationship between the excavation reactive force calculated during a first excavation operation performed one or more times and the excavation weight.

19 Claims, 13 Drawing Sheets

SHOVEL

RELATED APPLICATION

The present application is based on and claims priority to Japanese Patent Application No. 2023-218209 filed on Dec. 25, 2023, the entire contents of which are hereby incorporated by reference.

BACKGROUND

1. Field of the Invention

The present disclosure relates to shovels.

2. Description of the Related Art

Conventionally, there has been known a shovel for calculating the weight of earth and sand loaded in a bucket lifted into the air based on the measured value of a boom bottom pressure sensor.

SUMMARY

A shovel according to an embodiment of the present disclosure is a shovel for moving an object to a predetermined place by repeating a series of operations including an excavation operation and a dumping operation, and is provided with a lower traveling body, an upper swivel body pivotably mounted on the lower traveling body, an attachment attached to the upper swivel body, a sensor attached to the upper swivel body, and a control device configured to calculate, based on an output of the sensor, an excavation reactive force generated by the excavation operation and an excavation weight which is the weight of the object taken into a bucket and moved to the predetermined place, wherein the control device is further configured to set a target value related to the excavation reactive force of a second excavation operation subsequently performed one or more times based on a relationship between the excavation reactive force calculated during a first excavation operation performed one or more times and the excavation weight.

DETAILED DESCRIPTION

The shovel described above may not be able to properly calculate the weight of an object, such as earth and sand, loaded in the bucket when the detected value of the boom bottom pressure sensor varies due to disturbance generated when the bucket is lifted in the air. In this case, the shovel may not be able to accurately calculate the weight of the object moved (loaded) to a predetermined place, such as the bed of a dump truck, by an excavation attachment.

Therefore, it is desirable to be able to more accurately calculate the weight of an object moved to a predetermined place.

Figure 1:
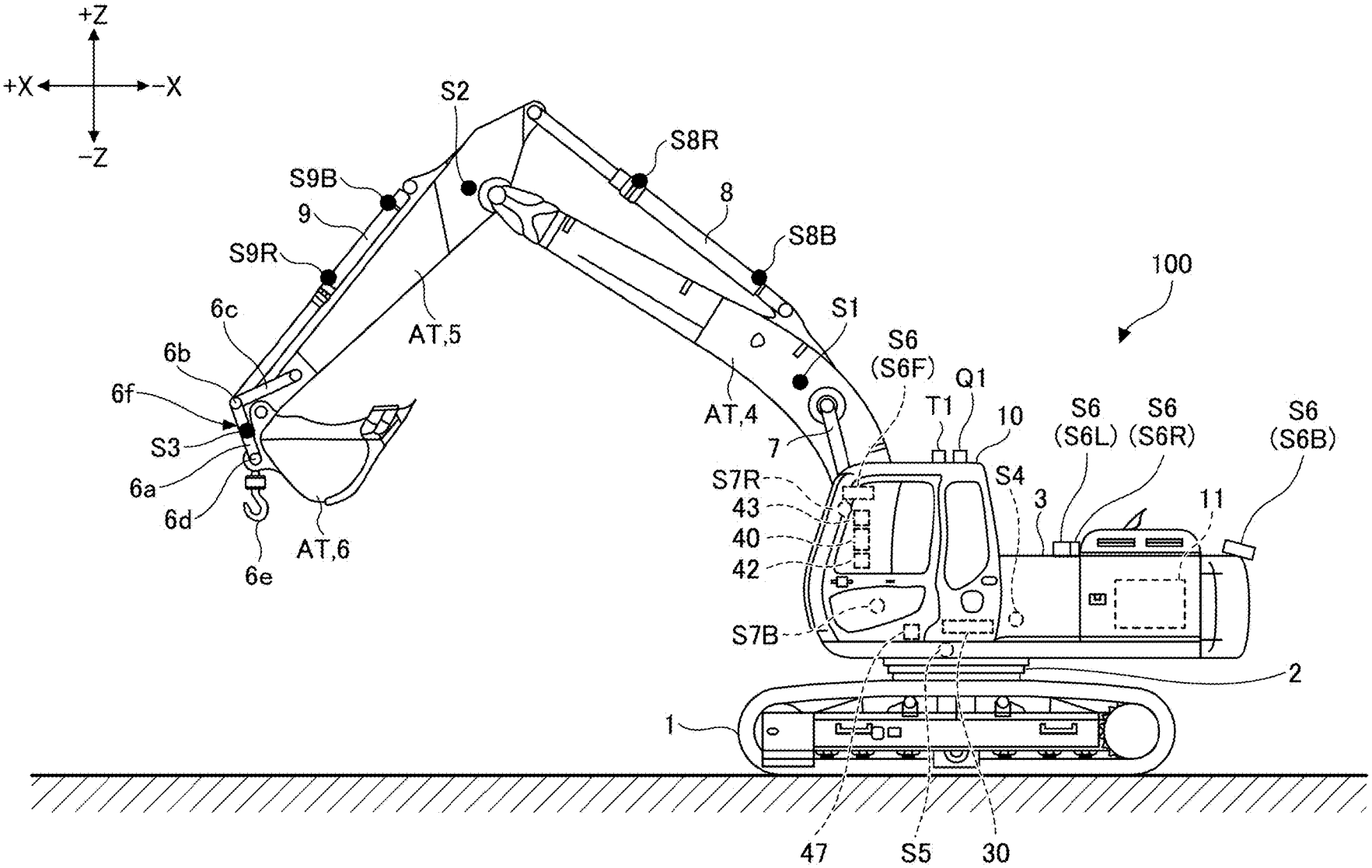
FIG. 1 is a side view of a shovel.

Hereinafter, a shovel 100 according to an embodiment of the present disclosure will be described with reference to the drawings. First, an outline of the shovel 100 will be described with reference to FIG. 1. FIG. 1 is a side view of the shovel 100.

The shovel 100 includes a lower traveling body 1, an upper swivel body 3 mounted on the lower traveling body 1 so as to be able to turn via a turner 2, a boom 4, an arm 5, and a bucket 6 constituting an excavation attachment as an example of an attachment AT, and a cab 10.

Figure 2:
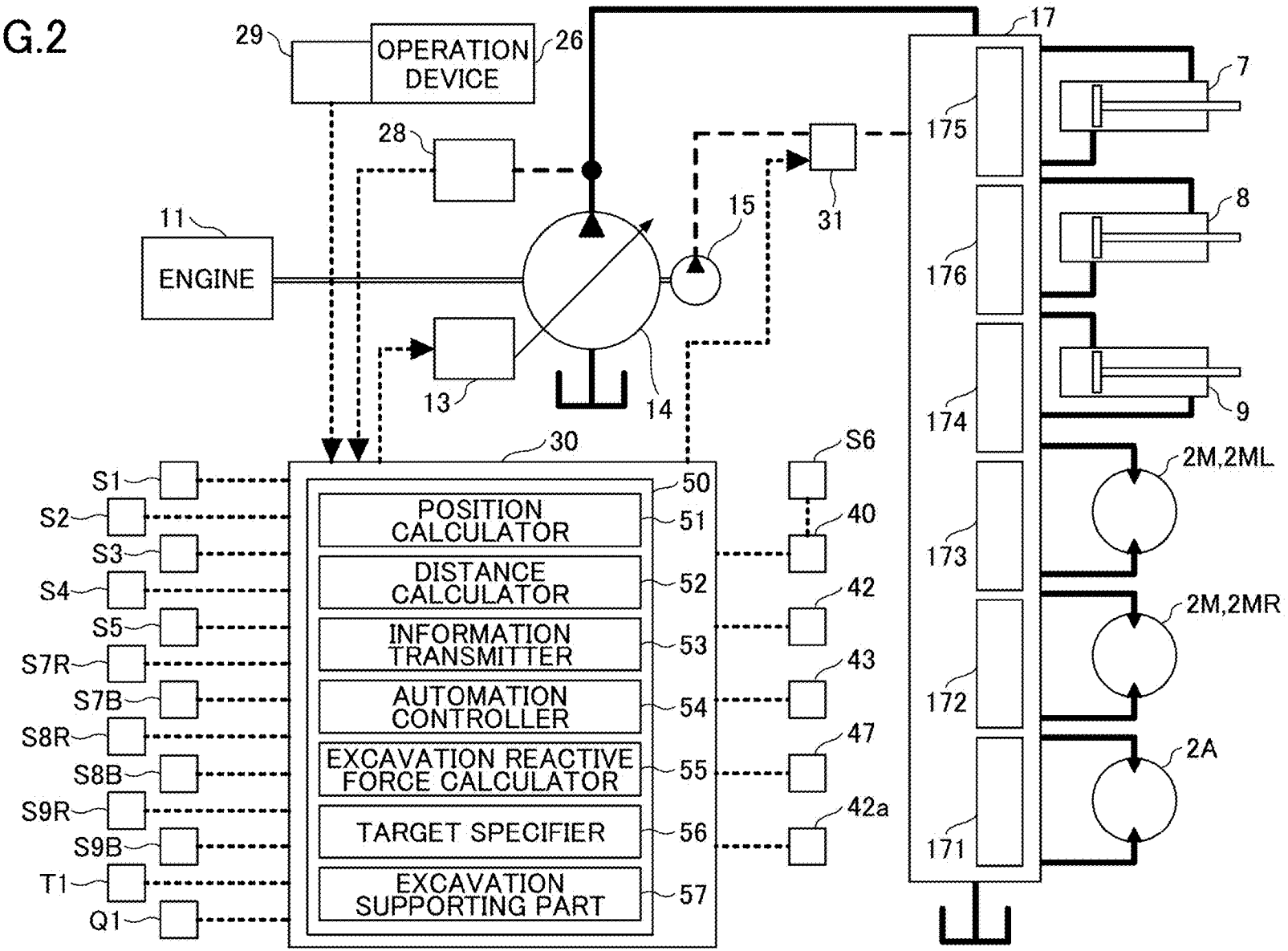
FIG. 2 is a diagram schematically illustrating an example configuration of a shovel control system.

The lower traveling body 1 drives the shovel 100 by a pair of left and right crawlers being respectively hydraulically driven by a traveling hydraulic motor 2M (see FIG. 2). The traveling hydraulic motor 2M includes a left traveling hydraulic motor 2ML and a right traveling hydraulic motor 2MR. That is, the left traveling hydraulic motor 2ML and the right traveling hydraulic motor 2MR drive the lower traveling body 1 (crawler) as a driven part.

The upper swivel body 3 is driven by a swivel hydraulic motor 2A (see FIG. 2) to swivel with respect to the lower traveling body 1. In other words, the swivel hydraulic motor 2A is a swivel driving section for driving the upper swivel body 3 as a driven section, and can change the direction of the upper swivel body 3.

The upper swivel body 3 may be electrically driven by a swivel motor as an electric actuator instead of the swivel hydraulic motor 2A. In other words, the swivel motor, like the swivel hydraulic motor 2A, is a swivel driving section for driving the upper swivel body 3 as a driven section, and can change the direction of the upper swivel body 3.

The boom 4 is rotatably attached to the front center of the upper swivel body 3, the arm 5 is rotatably attached to the tip of the boom 4, and the bucket 6 as an end attachment is rotatably attached to the tip of the arm 5. The boom 4, the arm 5, and the bucket 6 are respectively hydraulically driven by a boom cylinder 7, an arm cylinder 8, and a bucket cylinder 9 as hydraulic actuators.

The bucket 6 is an example of an end attachment, and other end attachments, such as a slope bucket, a dredging bucket, or a breaker, may be attached to the tip of the arm 5 in place of the bucket 6 according to the contents of the work.

The cab 10 is an operator's cab in which an operator rides, and is provided on the front left side of the upper swivel body 3.

Next, a specific configuration of the shovel 100 will be described with reference to FIG. 2 in addition to FIG. 1. FIG. 2 is a diagram schematically illustrating a configuration example of a control system of the shovel 100. In FIG. 2, a mechanical power transmission line, a hydraulic oil line, a pilot line, and an electric signal line are indicated by double lines, solid lines, broken lines, and dotted lines, respectively.

The drive system of the shovel 100 includes an engine 11, a regulator 13, a main pump 14, and a control valve group 17. The hydraulic drive system of the shovel 100 includes hydraulic actuators such as a traveling hydraulic motor 2M, a swivel hydraulic motor 2A, a boom cylinder 7, an arm cylinder 8, and a bucket cylinder 9 for hydraulically driving the lower traveling body 1, the upper swivel body 3, the boom 4, the arm 5, and the bucket 6, respectively.

The engine 11 is a power source in a hydraulic drive system, and is mounted, for example, at the rear of the upper swivel body 3. Specifically, the engine 11 rotates at a predetermined target speed under direct or indirect control by a controller 30 to drive the main pump 14 and a pilot pump 15. The engine 11 is, for example, a diesel engine.

The regulator 13 controls a discharge amount of the main pump 14. For example, the regulator 13 adjusts the angle (inclination angle) of a swash plate of the main pump 14 according to a control command from the controller 30. The regulator 13 includes, for example, a left regulator 13L and a right regulator 13R (see FIG. 3).

The main pump 14 is mounted, for example, on the rear of the upper swivel body 3, and supplies hydraulic oil to the control valve group 17 through a hydraulic oil line. The main pump 14 is driven by the engine 11. The main pump 14 is, for example, a variable displacement hydraulic pump, and under the control of the controller 30, the inclination angle of the swash plate is adjusted by the regulator 13 to adjust a stroke length of a piston, thereby controlling a discharge flow rate (displacement volume). The main pump 14 includes, for example, a left main pump 14L and a right main pump 14R (see FIG. 3).

The control valve group 17 is, for example, a hydraulic control device mounted in a central portion of the upper swivel body 3 and controlling the hydraulic drive system in response to an operation of an operation device 26 by an operator. The control valve group 17 is connected to the main pump 14 via the hydraulic oil line, and selectively supplies hydraulic oil supplied from the main pump 14 to each of the plurality of hydraulic actuators (traveling hydraulic motor 2M, swivel hydraulic motor 2A, boom cylinder 7, arm cylinder 8, and bucket cylinder 9) in response to an operation state of the operation device 26. More specifically, the control valve group 17 includes control valves 171 to 176 for controlling a flow rate and a flow direction of hydraulic oil supplied from the main pump 14 to each of the hydraulic actuators. More specifically, the control valve 171 corresponds to the left traveling hydraulic motor 2ML, the control valve 172 corresponds to the right traveling hydraulic motor 2MR, and the control valve 173 corresponds to the swivel hydraulic motor 2A. The control valve 174 corresponds to the bucket cylinder 9, the control valve 175 corresponds to the boom cylinder 7, and the control valve 176 corresponds to the arm cylinder 8. The control valve 175 includes, for example, a control valve 175L and a control valve 175R, and the control valve 176 includes, for example, control valves 176L and 176R (see FIG. 3).

An operation system of the shovel 100 includes the pilot pump 15 and the operation device 26. An operation system of the shovel 100 includes a solenoid valve 31 as a configuration related to a machine control function by the controller 30.

The pilot pump 15 is mounted, for example, on the rear of the upper swivel body 3, and supplies pilot pressure to each pilot port of the control valves 171 to 176 via the pilot line. The pilot pump 15 is, for example, a fixed displacement hydraulic pump and is driven by the engine 11.

The operation device 26 is provided near the driver's seat in the cab 10 and is an operation input means for an operator to operate various operating elements (lower traveling body 1, upper swivel body 3, boom 4, arm 5, bucket 6, etc.). In other words, the operation device 26 is an operation input means for an operator to operate a hydraulic actuator (traveling hydraulic motor 2M, swivel hydraulic motor 2A, boom cylinder 7, arm cylinder 8, bucket cylinder 9, etc.) for driving each operating element. A pilot pressure corresponding to the operation contents (operation direction and operation amount) of the operation device 26 is input to each pilot port of the control valves 171 to 176. In the illustrated example, the operation device 26 includes a left operation lever 26L (see FIG. 4A) which is a lever device for operating the upper swivel body 3 (rotating hydraulic motor 2A) and the arm 5 (arm cylinder 8), a right operation lever 26R (see FIG. 4B) which is a lever device for operating the boom 4 (boom cylinder 7) and the bucket 6 (bucket cylinder 9), and a travel operation device 26D (see FIG. 4E) which operates the crawler (traveling hydraulic motor 2M) of the lower traveling body 1. The travel operation device 26D includes a left traveling lever 26DL (see FIG. 4E) for operating the left crawler (left traveling hydraulic motor 2ML), and a right traveling lever 26DR (see FIG. 4F) for operating the right crawler (right traveling hydraulic motor 2MR). The travel operation device 26D may include a left travel pedal for operating the left crawler (left traveling hydraulic motor 2ML), and a right travel pedal for operating the right crawler (right traveling hydraulic motor 2MR).

In the illustrated example, the operation device 26 is of an electric type for outputting an electric signal, and the electric signal from the operation device 26 is input to the controller 30. The controller 30 controls the pilot pressure acting on the pilot ports of the control valves 171 to 176 in accordance with the input electric signal, thereby achieving the operation of the various hydraulic actuators in accordance with the operation contents of the operation device 26. Specifically, the solenoid valve 31 operating in accordance with the electric signal from the controller 30 is disposed between the pilot pump 15 and the pilot ports of the control valves 171 to 176. When the operation device 26 is operated, the controller 30 controls the solenoid valve 31 in accordance with the electric signal corresponding to an operation amount (for example, lever operation amount) thereof to increase or decrease the pilot pressure, thereby allowing the control valves 171 to 176 to operate in accordance with the operation contents of the operation device 26. The control valves 171 to 176 may be a solenoid spool valve driven in accordance with a command from the controller 30.

The control system of the shovel 100 includes the controller 30, a discharge pressure sensor 28, an operation sensor 29, the solenoid valve 31, a display device 40, an input device 42, a sound output device 43, a storage device 47, a boom angle sensor S1, an arm angle sensor S2, a bucket angle sensor S3, a machine-body inclination sensor S4, a turning state sensor S5, an imaging device S6, a positioning device Q1, and a communicator T1.

The controller 30 (an example of the control device) is provided in the cab 10 and is configured to control the drive of the shovel 100. The functions of the controller 30 may be implemented by any hardware, software, or a combination thereof. In the illustrated example, the controller 30 is configured around a microcomputer including a central processing unit (CPU), a read only memory (ROM), a random access memory (RAM), a nonvolatile auxiliary storage device, and various input/output interfaces. The controller 30 implements various functions by executing various programs stored in the ROM or the nonvolatile auxiliary storage device on the CPU, for example.

In the illustrated example, the controller 30 sets a target rotational speed based on a work mode or the like that is set in advance by a predetermined operation by an operator or the like, and performs drive control for rotating the engine 11 at a constant speed. The controller 30 may output a control command to the regulator 13 as necessary to change the discharge amount of the main pump 14.

The controller 30 may be configured to control a machine guidance function for guiding a manual operation of the shovel 100 through the operation device 26 by an operator. The controller 30 may be configured to control a machine control function for automatically supporting a manual operation of the shovel 100 through the operation device 26 by an operator. In this case, the controller 30 may include a machine guidance part 50 as a functional part related to the machine guidance function and the machine control function.

A part of the function of the controller 30 may be implemented by another controller (control device). That is, the function of the controller 30 may be implemented in a manner distributed by a plurality of controllers. For example, the machine guidance function and the machine control function may be implemented by a dedicated controller (control device).

The discharge pressure sensor 28 detects the discharge pressure of the main pump 14. A detection signal corresponding to a discharge pressure detected by the discharge pressure sensor 28 is taken into the controller 30. The discharge pressure sensor 28 includes, for example, a left discharge pressure sensor 28L and a right discharge pressure sensor 28R (see FIG. 3).

The operation sensor 29 detects the operation contents (operation direction and operation amount) of the operation device 26. The detection signal of the operation sensor 29 is taken into the controller 30. The operation sensor 29 includes, for example, an operation sensor 29LA (see FIG. 4A) for detecting the operation contents of the left operation lever 26L in a longitudinal direction (arm operation direction), an operation sensor 29RA (see FIG. 4B) for detecting the operation contents of the right operation lever 26R in the longitudinal direction (boom operation direction), an operation sensor 29RB (see FIG. 4C) for detecting the operation contents of the right operation lever 26R in a lateral direction (bucket operation direction), an operation sensor 29 LB (see FIG. 4D) for detecting the operation contents of the left operation lever 26L in the lateral direction (turn operation direction), an operation sensor 29DL (see FIG. 4E) for detecting the operation contents of the left traveling lever 26DL, and an operation sensor 29DR (see FIG. 4F) for detecting the operation contents of the right traveling lever 26DR.

In the illustrated example, the operation sensor 29 is an inclination sensor capable of detecting the operation amount (inclination amount) and inclination direction of the operation device 26, but may be any sensor such as an encoder or a potentiometer.

The solenoid valve 31 is provided on a pilot line connecting the pilot pump 15 and the respective pilot ports of the control valves 171 to 176, and is configured so as to be able to change a flow path area (cross-sectional area through which hydraulic oil can flow) thereof. The solenoid valve 31 operates in response to a control command input from the controller 30. Thus, the controller 30 can supply the pilot oil discharged from the pilot pump 15 to the respective pilot ports of the control valves 171 to 176 via the solenoid valve 31 even when the operation device 26 is not operated by an operator. In the illustrated example, the solenoid valve 31 includes a solenoid valve 31AL to a solenoid valve 31FL and a solenoid valve 31AR to a solenoid valve 31FR, as illustrated in FIGS. 4A to 4F.

The display device 40 is provided in the cab 10 at a location easily visible from an operator seated in the driver's seat, and displays various information under control of the controller 30. The display device 40 may be connected to the controller 30 via an on-vehicle communication network, or may be connected to the controller 30 via a one-to-one dedicated line.

The input device 42 is provided within a range within reach of an operator seated in the driver's seat in the cab 10, receives various operation inputs from the operator, and outputs signals corresponding to the operation inputs to the controller 30. The input device 42 may be, for example, a touch panel mounted on a screen of the display device 40 for displaying various information, a knob switch provided at a tip of the lever portion of the lever device, and a button switch, a lever, a toggle switch, or a rotary dial provided around the display device 40. A signal corresponding to an operation on the input device 42 is taken into the controller 30.

The input device 42 includes a mode switch 42*a*. The mode switch 42*a* is a switch for switching the operation mode of the shovel 100. The operation mode means a type of operation performed by the shovel 100, and includes, for example, a crane mode, a normal mode, and the like. The mode switch 42*a* may be a software switch displayed on the screen of the display device 40, a hardware switch installed around the display device 40, or a switch installed at another position in the cab 10.

The sound output device 43 is provided in the cab 10, is connected to the controller 30, and outputs sound under the control of the controller 30. The sound output device 43 is, for example, a speaker or a buzzer. The sound output device 43 audibly outputs various kinds of information in response to a sound output command from the controller 30.

The storage device 47 is provided in the cab 10, for example, and stores various kinds of information under the control of the controller 30. The storage device 47 is, for example, a nonvolatile storage medium such as a semiconductor memory. The storage device 47 may store information output by various devices during the operation of the shovel 100, or may store information obtained through various devices before the operation of the shovel 100 is started. The storage device 47 may store, for example, data regarding a target point obtained via the communicator T1 or set via the input device 42 or the like. The target point is, for example, a point on a target construction surface. The data regarding the target point may be set (stored) by an operator of the shovel 100 or set by a construction manager or the like.

The boom angle sensor S1 is attached to the boom 4 and detects an angle of rotation (hereinafter referred to as "boom angle") of the boom 4 with respect to the upper swivel body 3, for example, an angle formed by a straight line connecting points (center points of connecting pins) at both ends of the boom 4 with respect to a turning plane (a plane perpendicular to a turning axis) of the upper swivel body 3 in a side view. The boom angle sensor S1 is, for example, a rotary encoder, an acceleration sensor, a 6-axis sensor, an inertial measurement unit (IMU), or a combination thereof. The boom angle sensor S1 may include a potentiometer using a variable resistor, a cylinder sensor for detecting a stroke amount of a hydraulic cylinder (boom cylinder 7) corresponding to the boom angle, or the like. The same applies to the arm angle sensor S2 and the bucket angle sensor S3. A detection signal corresponding to the boom angle by the boom angle sensor S1 is taken into the controller 30.

The arm angle sensor S2 is attached to the arm 5, and detects an angle of rotation (hereinafter referred to as "arm angle") of the arm 5 with respect to the boom 4, for example, an angle formed by a straight line connecting points at both ends of the arm 5 (center points of the connecting pins) with respect to a straight line connecting points at both ends of the boom 4 (center points of the connecting pins) in a side view. A detection signal corresponding to the arm angle by the arm angle sensor S2 is taken into the controller 30.

The bucket angle sensor S3 is attached to the bucket 6, and detects an angle of rotation (hereinafter referred to as "bucket angle") of the bucket 6 with respect to the arm 5, for example, an angle formed by a straight line connecting the fulcrum (center point of the connecting pins) and the tip (toe) of the bucket 6 with respect to a straight line connecting points at both ends of the arm 5 (center points of the connecting pins) in a side view. A detection signal corresponding to the bucket angle by the bucket angle sensor S3 is taken into the controller 30. The bucket angle sensor S3 may be omitted. In this case, the controller 30 may estimate the bucket angle based on the output of the operation sensor 29RB.

The machine-body inclination sensor S4 detects a state of inclination of the machine body (upper swivel body 3 or lower traveling body 1) with respect to a horizontal plane. The machine-body inclination sensor S4 is attached to the upper swivel body 3, for example, and detects an inclination angle (hereinafter, the "longitudinal inclination angle" and the "lateral inclination angle") of the shovel 100 (namely, the upper swivel body 3) around two axes in the longitudinal direction and the lateral direction. The machine-body inclination sensor S4 is, for example, a rotary encoder, an acceleration sensor, a 6-axis sensor, the IMU, or a combination thereof. The detection signal corresponding to the inclination angle (longitudinal inclination angle and lateral inclination angle) by the machine-body inclination sensor S4 is taken into the controller 30.

A turning state sensor S5 outputs information related to a turning state of the upper swivel body 3. The turning state sensor S5 detects, for example, a turning angular velocity of the upper swivel body 3. The turning state sensor S5 may detect the turning angle. The turning state sensor S5 is, for example, a gyro sensor, a resolver, or a rotary encoder. A detection signal corresponding to the turning angular velocity of the upper swivel body 3 by the turning state sensor S5 is taken into the controller 30.

An imaging device S6 as a space recognition device images the periphery of the shovel 100. In the illustrated example, the imaging device S6 includes a camera S6F for imaging the front of the shovel 100, a camera S6L for imaging the left side of the shovel 100, a camera S6R for imaging the right side of the shovel 100, and a camera S6B for imaging the rear of the shovel 100. The imaging device S6 may be directly connected to the controller 30 in a communicable manner.

In the illustrated example, the camera S6F is mounted on the ceiling of the cab 10, that is, inside the cab 10. The camera S6F may be mounted outside the cab 10, such as on the roof of the cab 10 or on a side of the boom 4. The camera S6L is mounted on a left end of an upper surface of the upper swivel body 3, the camera S6R is mounted on a right end of the upper surface of the upper swivel body 3, and the camera S6B is mounted on a rear end of the upper surface of the upper swivel body 3.

Each of the imaging devices S6 (camera S6F, camera S6B, camera S6L, and camera S6R) is, for example, a monocular wide-angle camera that provides a wide angle of view. Each of the imaging devices S6 may be a stereo camera, a distance image camera, or the like. Images taken by each of the imaging devices S6 are taken into the controller 30 via the display device 40.

The imaging device S6 as the space recognition device may function as an object detection device. In this case, the imaging device S6 may detect an object existing around the shovel 100. The object to be detected may include, for example, a person, an animal, a vehicle, a construction machine, a building, a hole, and the like. The imaging device S6 as the object detection device may calculate a distance to the object recognized by the imaging device S6 or the shovel 100. The imaging device S6 as the object detection device may be a stereo camera, a distance image sensor, or the like. Specifically, the imaging device S6 is a monocular camera including an imaging element such as a CCD or a CMOS, and outputs the picked up image to the display device 40.

In addition to the imaging device S6, the shovel 100 may be provided with another object detection device such as an ultrasonic sensor, a millimeter wave radar, a LIDAR, an infrared sensor, or the like as the space recognition device. The millimeter wave radar, the ultrasonic sensor, a laser radar, or the like as the space recognition device may emit a large number of signals (laser light, etc.) toward an object, and may detect the distance and direction of the object from a reflected signal by receiving the reflected signal.

A boom rod pressure sensor S7R and a boom bottom pressure sensor S7B are attached to the boom cylinder 7. An arm rod pressure sensor S8R and an arm bottom pressure sensor S8B are attached to the arm cylinder 8. A bucket rod pressure sensor S9R and a bucket bottom pressure sensor S9B are attached to the bucket cylinder 9. At least one of the boom rod pressure sensor S7R, boom bottom pressure sensor S7B, arm rod pressure sensor S8R, arm bottom pressure sensor S8B, bucket rod pressure sensor S9R, or bucket bottom pressure sensor S9B is also collectively referred to as a "cylinder pressure sensor".

The boom rod pressure sensor S7R detects the pressure (hereinafter, referred to as "boom rod pressure") in a rod-side oil chamber of the boom cylinder 7, and the boom bottom pressure sensor S7B detects the pressure (hereinafter, referred to as "boom bottom pressure") in a bottom-side oil chamber of the boom cylinder 7. The arm rod pressure sensor S8R detects the pressure (hereinafter, referred to as "arm rod pressure") in a rod-side oil chamber of the arm cylinder 8, and the arm bottom pressure sensor S8B detects the pressure (hereinafter, referred to as "arm bottom pressure") in a bottom-side oil chamber of the arm cylinder 8. The bucket rod pressure sensor S9R detects the pressure (hereinafter, referred to as "bucket rod pressure") in a rod-side oil chamber of the bucket cylinder 9, and the bucket bottom pressure sensor S9B detects the pressure (hereinafter, referred to as "bucket bottom pressure") in a bottom-side oil chamber of the bucket cylinder 9.

The positioning device Q1 is configured to measure the position of the upper swivel body 3. In the illustrated example, the positioning device Q1 is a global navigation satellite system (GNSS) compass, and detects the position and orientation of the upper swivel body 3, and a detection signal corresponding to the position and orientation of the upper swivel body 3 is taken into the controller 30. The orientation of the upper swivel body 3 may be detected by another device such as an orientation sensor attached to the upper swivel body 3.

The communicator T1 is configured to communicate with an external device through any communication network including a mobile communication network, a satellite communication network, or an Internet network. More specifically, the communicator T1 may be configured with a mobile communication module corresponding to a mobile communication standard such as long term evolution (LTE), 4th generation (4G), or 5th generation (5G), or a satellite communication module for connecting to the satellite communication network.

The machine guidance part 50 is configured to execute a machine guidance function. In the illustrated example, the machine guidance part 50 transmits work information such as a distance between a target point and a control point (e.g., a working portion of the end attachment) to the operator via the display device 40 or the sound output device 43. Data related to the target point is stored in advance in the storage device 47. The data concerning the target point is expressed in a reference coordinate system. The reference coordinate system is, for example, a world geodetic system. The world geodetic system is a three-dimensional orthogonal XYZ coordinate system in which the origin is located at the center of gravity of the earth, the X-axis is in a direction of the intersection of the Greenwich meridian and the equator, the Y-axis is in a direction of the 90 degrees east longitude, and the Z-axis is in the direction of the North Pole. The operator may set any point on the construction site as a reference point through the input device 42, and set a relative positional relationship between the reference point and the target point. The working portion of the end attachment is, for example, the toe of the bucket 6 or the back of the bucket 6. The machine guidance part 50 notifies the operator of work information through the display device 40 or the sound output device 43, and guides the operation of the shovel 100 through the operation device 26 by the operator.

The machine guidance part 50 may be configured to perform a machine control function. The machine guidance part 50 may automatically operate, for example, at least one of the swivel hydraulic motor 2A, the traveling hydraulic motor 2M, the boom 4, the arm 5, or the bucket 6 such that the target point and the control point (a point at the working portion of the end attachment) coincide when the operator is performing a manual operation.

In the illustrated example, the machine guidance part 50 obtains information from the boom angle sensor S1, the arm angle sensor S2, the bucket angle sensor S3, the machine-body inclination sensor S4, the turning state sensor S5, the imaging device S6, the positioning device Q1, the communicator T1, the input device 42, and the like. Based on the obtained information, the machine guidance part 50 calculates the distance between the target point and the control point, notifies the operator of the size of the distance between the target point and the control point by sound from the sound output device 43 and by an image displayed on the display device 40, and automatically controls the operation of the actuator such that the control point and the target point coincide. As functional elements related to the machine guidance function and the machine control function, the machine guidance part 50 includes a position calculator 51, a distance calculator 52, an information transmitter 53, an automation controller 54, an excavation reactive force calculator 55, a target specifier 56, and an excavation supporting part 57.

The position calculator 51 is configured to calculate the position of a predetermined positioning object. For example, the position calculator 51 calculates coordinates of the control point in the reference coordinate system. Specifically, the position calculator 51 calculates the coordinates of the control point from the traveling distance of the lower traveling body 1, the turning angle of the upper swivel body 3, and the respective turning angles (boom angle, arm angle, and bucket angle) of the boom 4, the arm 5, and the bucket 6.

The distance calculator 52 is configured to calculate the distance between two positioning objects. In the illustrated example, the distance calculator 52 calculates the distance between the control point and the target point. For example, the distance calculator 52 calculates a distance or the like between a control point on the toe of the bucket 6 and a point on the target construction surface.

The information transmitter 53 transmits (notifies) various kinds of information to the operator of the shovel 100 through a notification means such as the display device 40 or the sound output device 43. The information transmitter 53 may notify the operator of the shovel 100 of the magnitudes of the various distances or the like calculated by the distance calculator 52. For example, the information transmitter 53 may use at least one of the visual information by the display device 40 or the auditory information by the sound output device 43 to inform the operator of the magnitude of the distance between the control point and the target point.

Specifically, the information transmitter 53 may use intermittent sounds by the sound output device 43 to inform the operator of the magnitude of the distance between the control point and the target point. In this case, the information transmitter 53 may shorten the interval between the intermittent sounds as the distance decreases, and may lengthen the interval between the intermittent sounds as the distance increases. Furthermore, the information transmitter 53 may use continuous sounds, and may indicate the difference in the magnitude of the distance while changing the pitch or strength of the sounds. Furthermore, the information transmitter 53 may issue an alarm through the sound output device 43 when the control point at the tip of the bucket 6 is located lower than the target construction surface, that is, when the control point exceeds the target construction surface. The alarm is, for example, a continuous sound that is significantly larger than an intermittent sound.

In addition, the information transmitter 53 may cause the display device 40 to display the magnitude of the distance between the control point and the target point as work information. The display device 40 may display the work information received from the information transmitter 53 together with the image data received from the imaging device S6 under the control of the controller 30. The information transmitter 53 may use an image of an analog meter, an image of a bar graph indicator, or the like to notify the magnitude of the distance to the operator.

The automation controller 54 automatically supports the manual operation of the shovel 100 by the operator through the operation device 26 by automatically operating the actuator. Specifically, the automation controller 54 can individually and automatically adjust the pilot pressure acting on the pilot port of the control valve corresponding to each of the plurality of hydraulic actuators. Thus, the automation controller 54 can automatically operate the respective hydraulic actuators. The control of the machine control function by the automation controller 54 may be performed, for example, when a predetermined switch included in the input device 42 is pressed. The predetermined switch is, for example, a machine control switch (hereinafter, "Machine Control (MC) switch"), and may be disposed as a knob switch at a tip of a grip portion of the operation device 26 (for example, an arm operation lever which is a lever device used for operating the arm 5). The following description relates to a machine control function executed when the MC switch is pressed.

For example, when the MC switch or the like is pressed, the automation controller 54 automatically extends or contracts at least one of the boom cylinder 7 or the bucket cylinder 9 in accordance with the operation of the arm cylinder 8 according to the operation of the arm operation lever in order to support excavation work. Specifically, when the operator is manually closing the arm 5 (hereinafter, "arm-closing operation"), the automation controller 54 automatically extends or contracts at least one of the boom cylinder 7 or the bucket cylinder 9 such that a target point on the target construction surface matches with a control point on a work site such as the toe or back surface of the bucket 6. In this case, the operator can close the arm 5 while making the toe or the like of the bucket 6 coincide with the target construction surface by simply operating the arm operation lever in an arm closing direction, for example.

The excavation reactive force calculator 55 is configured to derive an excavation reactive force. The excavation reactive force is the reactive force of the excavation force, has the same magnitude as the excavation force, and is a force in a direction opposite to that of the excavation force. In the illustrated example, the excavation reactive force calculator 55 derives an excavation reactive force based on the attitude of the excavation attachment and the load acting on the excavation attachment. The attitude of the excavation attachment is detected by an attitude sensor. The attitude sensor includes at least one of the boom angle sensor S1, the arm angle sensor S2, or the bucket angle sensor S3. The load acting on the excavation attachment is detected by the cylinder pressure sensor. The cylinder pressure sensor includes at least one of the boom rod pressure sensor S7R, the boom bottom pressure sensor S7B, the arm rod pressure sensor S8R, the arm bottom pressure sensor S8B, the bucket rod pressure sensor S9R, or the bucket bottom pressure sensor S9B.

Specifically, the excavation reactive force calculator 55 repeatedly calculates the excavation reactive force at a predetermined calculation period by using a predetermined calculation formula. The excavation reactive force calculator 55 calculates the excavation reactive force such that the deeper the excavation depth, that is, the greater a vertical distance between the contact surface of the shovel 100 and the toe of the bucket 6, the greater the excavation reactive force. Furthermore, the excavation reactive force calculator 55 calculates the excavation reactive force such that the greater a ground insertion depth, which is the depth of the toe of the bucket 6 in the ground to be excavated, the greater the excavation reactive force. The excavation reactive force calculator 55 may also calculate the excavation reactive force in consideration of earth and sand characteristics such as earth and sand density. The earth and sand characteristics may be values input by an operator through the input device 42 or the like, or may be values automatically calculated based on outputs from various sensors such as the cylinder pressure sensor. The excavation reactive force calculator 55 may be configured to calculate at least one of a horizontal component or a vertical component of the excavation reactive force.

The target specifier 56 is configured to set a target value related to the excavation operation. In the illustrated example, the target specifier 56 is configured to determine whether or not a predetermined excavation operation suitable for calculating the target value has been performed based on information related to the excavation operation performed by the attachment AT with respect to a constructing object (excavation target ground) at the work site, and to set a target value based on the excavation reactive force calculated when the excavation operation is determined to be the predetermined excavation operation. The target specifier 56 may determine that the predetermined excavation operation has been performed when the predetermined excavation operation has been performed a predetermined number of times. That is, even when the predetermined excavation operation has been performed, the target specifier 56 may determine that the predetermined excavation operation has not been performed when the number of times the predetermined excavation operation is performed is less than the predetermined number of times. In the following, the excavation operation performed before the target value is set may be referred to as "first excavation operation", and the excavation operation performed after the target value is set may be referred to as "second excavation operation".

The information related to the excavation operation is information related to an excavation amount such as the amount of earth and sand taken into the bucket 6. The amount of earth and sand taken into the bucket 6 is typically the volume of earth and sand contained in the bucket 6 in the air after the excavation operation and before the dumping operation. The volume of earth and sand may be calculated, for example, based on an image of the bucket 6 in the air captured by the camera S6F. Alternatively, the amount of earth and sand taken into the bucket 6 may be estimated based on an image of the ground (the ground above the bucket 6 in the ground) captured by the camera S6F. Specifically, the amount of earth and sand may be estimated based on a state of the ground raised by the movement of the bucket 6 in the second half of the excavation operation (the movement of the bucket 6 lifted from the ground by a boom-raising operation). Alternatively, the amount of earth and sand taken into the bucket 6 may be estimated based on an image of the ground before the excavation operation and an image of the ground after the excavation operation captured by the camera S6F. Specifically, the amount of earth and sand may be estimated based on a change in the shape of the ground before and after the excavation operation. Alternatively, the amount of earth and sand taken into the bucket 6 may be determined based on the weight of the earth and sand contained in the bucket 6. The weight of the earth and sand may be calculated based on the output of the attitude sensor and an output of the cylinder pressure sensor, for example.

When the amount of earth and sand taken into the bucket 6 is obtained, the target specifier 56 determines that a predetermined excavation operation suitable for calculating the target value has been performed when it can be recognized that the bucket 6 is filled with earth and sand, or when it can be recognized that the amount of earth and sand (volume or weight) taken into the bucket 6 is larger than a predetermined amount (predetermined volume or predetermined weight), such as when it can be recognized that the amount of earth and sand taken into the bucket 6 is 80% or 90% of the capacity of the bucket 6.

The information related to the excavation operation may be information input by the operator of the shovel 100. The information input by the operator of the shovel 100 is, for example, information for informing the controller 30 that the operator has determined that a predetermined excavation operation has been performed. The operator of the shovel 100 can, for example, inform the controller 30 that the operator has determined that a predetermined excavation operation has been performed by pressing a predetermined button that is one of the input devices 42.

The predetermined excavation operation is an excavation operation suitable for calculating a target value, and may be, for example, an excavation operation when the bucket 6 can be filled with earth and sand or an excavation operation when earth and sand can be taken in up to 80% or 90% of the capacity of the bucket 6.

The target value is a value used to reproduce the predetermined excavation operation, and may be, for example, a maximum value (maximum excavation reactive force) of the excavation reactive force calculated and recorded when the predetermined excavation operation has been performed. The target value may be a value calculated based on the maximum value of the excavation reactive force. For example, the target value may be a value obtained by adding a predetermined value to the maximum value of the excavation reactive force, or a value obtained by subtracting a predetermined value from the maximum value of the excavation reactive force. The target value may be a maximum value of the horizontal component of the excavation reactive force, or a maximum value of the vertical component of the excavation reactive force. The target value may be a value calculated based on a transition of the excavation reactive force calculated and recorded when the predetermined excavation operation is performed.

The target value may be an average value of the maximum values of the excavation reactive force in each of a plurality of predetermined excavation operations, that is, an average value of a plurality of maximum excavation reactive forces (maximum average excavation reactive force). The target value may be a median value, a mode value, or the like of a plurality of maximum excavation reactive forces.

The target specifier 56 may derive a correlation between the maximum value of the excavation reactive force and the excavation amount in each of one or a plurality of excavation operations, and then set the excavation reactive force corresponding to a desired excavation amount as the target value. In this case, the desired excavation amount, such as 80% or 90% of the capacity of the bucket 6, may be a preset excavation amount, or may be an excavation amount input through the input device 42. The correlation may be stored as a calculation formula such as a linear equation or a quadratic equation, or as a reference table.

The excavation supporting part 57 is configured to support the excavation operation performed by the operator of the shovel 100. In the illustrated example, the excavation supporting part 57 is configured to support each excavation operation after the target value is set by the target specifier 56. Specifically, when the value of the excavation reactive force repeatedly calculated during the excavation operation reaches the target value, the excavation supporting part 57 notifies the operator of the shovel 100 that the value of the excavation reactive force has reached the target value through a notification means such as the display device 40 or the sound output device 43. At this time, the operator performs the boom-raising operation to lift the bucket 6, which is at least partially underground, into the air, thereby ending the excavation operation in a state where the bucket 6 is filled with earth and sand.

The excavation supporting part 57 may automatically operate one or more actuators when the excavation reactive force reaches the target value. The automatic operation of the actuators means that the actuators are operated independently of the operation through the operation device 26. In the illustrated example, the actuator is at least one of the boom cylinder 7, the arm cylinder 8, or the bucket cylinder 9. In the illustrated example, the excavation supporting part 57 automatically extends the boom cylinder 7 when the excavation reactive force reaches the target value, raises the boom 4, and lifts the bucket 6, which is at least partially underground, into the air, thereby ending the excavation operation in a state where the bucket 6 is filled with earth and sand. When the excavation reactive force reaches the target value, the excavation supporting part 57 may stop the excavation operation by the excavation attachment even while the operation of the operation device 26 is being performed by the operator. After the excavation operation is stopped, the operator performs the boom-raising operation to raise the boom 4, and lifts the bucket 6, which is at least partially underground, into the air, thereby ending the excavation operation in a state where the bucket 6 is filled with earth and sand.

After the target value is set by the target specifier 56, the excavation supporting part 57 may be configured to support the excavation operation performed by the operator of the shovel 100 even when the value of the excavation reactive force repeatedly calculated during the excavation operation does not reach the target value. For example, the excavation supporting part 57 may automatically operate one or more actuators such that the working portion of the end attachment (the toe of the bucket 6) moves linearly until the value of the excavation reactive force reaches the target value. Specifically, the excavation supporting part 57 may automatically operate at least one of the boom cylinder 7, the arm cylinder 8, or the bucket cylinder 9 such that the toe of the bucket 6 moves linearly along a ground plane, the horizontal plane, a target construction plane, or the like during the excavation operation. In this case, the operator of the shovel 100 can, for example, move the toe of the bucket 6 under the ground linearly along the ground plane, the horizontal plane, the target construction plane, or the like until the value of the excavation reactive force reaches the target value by simply performing the arm-closing operation, and when the value of the excavation reactive force reaches the target value, the operator can lift the bucket 6, at least a part of which is under the ground, into the air and end the excavation operation in a state where the inside of the bucket 6 is filled with earth and sand. This configuration is effective, for example, when a groove of a certain depth is to be excavated.

Figure 3:
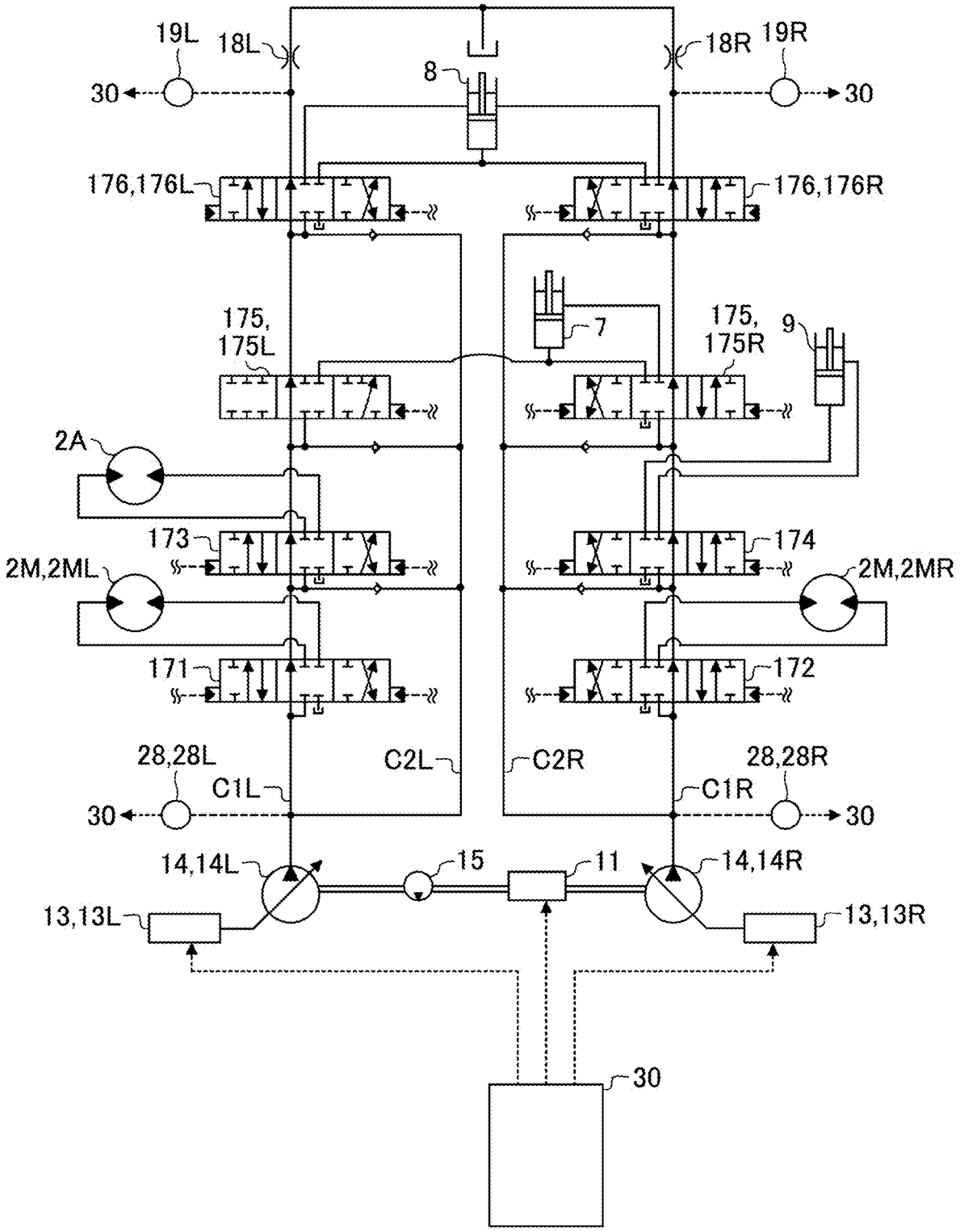
FIG. 3 is a diagram schematically illustrating an example configuration of a shovel hydraulic system.

Next, the hydraulic system of the shovel 100 will be described with reference to FIG. 3. FIG. 3 is a diagram schematically illustrating an example of the configuration of the hydraulic system of the shovel 100. In FIG. 3, the mechanical power transmission line, the hydraulic oil line, the pilot line, and the electric signal line are indicated by double lines, solid lines, broken lines, and dotted lines, respectively, as in the case of FIG. 2 and the like.

The hydraulic system circulates hydraulic oil from the left main pump 14L driven by the engine 11 to a hydraulic oil tank through a left central bypass oil path C1L and a left parallel oil path C2L, and circulates hydraulic oil from the right main pump 14R driven by the engine 11 to the hydraulic oil tank through a right central bypass oil path C1R and a right parallel oil path C2R.

The left central bypass oil path C1L starts from the left main pump 14L and passes in order through the control valve 171, the control valve 173, the control valve 175L, and the control valve 176L disposed in the control valve group 17 to reach the hydraulic oil tank.

The right central bypass oil path C1R starts from the right main pump 14R and passes in order through the control valve 172, the control valve 174, the control valve 175R, and the control valve 176R disposed in the control valve group 17 to reach the hydraulic oil tank.

The control valve 171 is a spool valve for supplying hydraulic oil discharged from the left main pump 14L to the left traveling hydraulic motor 2ML and for discharging hydraulic oil discharged from the left traveling hydraulic motor 2ML to the hydraulic oil tank.

The control valve 172 is a spool valve for supplying hydraulic oil discharged from the right main pump 14R to the right traveling hydraulic motor 2MR and for discharging hydraulic oil discharged from the right traveling hydraulic motor 2MR to the hydraulic oil tank.

The control valve 173 is a spool valve that supplies the hydraulic oil discharged from the left main pump 14L to the swivel hydraulic motor 2A and discharges the hydraulic oil discharged from the swivel hydraulic motor 2A to the hydraulic oil tank.

The control valve 174 is a spool valve that supplies the hydraulic oil discharged from the right main pump 14R to the bucket cylinder 9 and discharges the hydraulic oil in the bucket cylinder 9 to the hydraulic oil tank.

The control valve 175 includes the control valve 175L and the control valve 175R. The control valve 175L is a spool valve that supplies the hydraulic oil discharged from the left main pump 14L to the boom cylinder 7, and discharges the hydraulic oil in the boom cylinder 7 to the hydraulic oil tank. The control valve 175R is a spool valve that supplies the hydraulic oil discharged from the right main pump 14R to the boom cylinder 7, and discharges the hydraulic oil in the boom cylinder 7 to the hydraulic oil tank.

The control valve 176 includes the control valve 176L and the control valve 176R. The control valve 176L is a spool valve that supplies the hydraulic oil discharged from the left main pump 14L to the arm cylinder 8, and discharges the hydraulic oil in the arm cylinder 8 to the hydraulic oil tank. The control valve 176R is a spool valve that supplies the hydraulic oil discharged from the right main pump 14R to the arm cylinder 8, and discharges the hydraulic oil in the arm cylinder 8 to the hydraulic oil tank.

Each of the control valves 171 to 176 adjusts the flow rate of the hydraulic oil supplied to the hydraulic actuator, and switches the flow direction according to the pilot pressure acting on the pilot port.

The left parallel oil path C2L is arranged in parallel with the left central bypass oil path C1L and is configured to supply the hydraulic oil discharged from the left main pump 14L to the control valve 173, the control valve 175L, and the control valve 176L, respectively. Thus, the left parallel oil path C2L can supply the hydraulic oil to the control valve in further downstream when the flow of the hydraulic oil through the left central bypass oil path C1L is restricted or blocked by any of the control valve 171, the control valve 173, or the control valve 175L.

The right parallel oil path C2R is arranged in parallel with the right central bypass oil path C1R and is configured to supply the hydraulic oil discharged from the right main pump 14R to the control valve 174, the control valve 175R, and the control valve 176R, respectively. Thus, the right parallel oil path C2R can supply the hydraulic oil to the control valve in further downstream when the flow of the hydraulic oil through the right central bypass oil path C1R is restricted or blocked by any of the control valve 172, the control valve 174, or the control valve 175R.

The left regulator 13L is configured to adjust the discharge amount of the left main pump 14L by adjusting the inclination angle of the swash plate of the left main pump 14L under the control of the controller 30. The right regulator 13R is configured to adjust the discharge amount of the right main pump 14R by adjusting the inclination angle of the swash plate of the right main pump 14R under the control of the controller 30.

The left discharge pressure sensor 28L detects the discharge pressure of the left main pump 14L, and a detection signal corresponding to the detected discharge pressure is taken into the controller 30. The same applies to the right discharge pressure sensor 28R. Thus, the controller 30 can control the left regulator 13L according to the discharge pressure of the left main pump 14L, and can control the right regulator 13R according to the discharge pressure of the right main pump 14R.

In the left central bypass oil path C1L, a left throttle 18L is provided between the control valve 176L located at the most downstream and the hydraulic oil tank. Thus, the flow of the hydraulic oil discharged by the left main pump 14L is restricted by the left throttle 18L. The left throttle 18L generates left control pressure for controlling the left regulator 13L. The right central bypass oil path C1R is provided with a right throttle 18R between the control valve 176R located at the most downstream and the hydraulic oil tank. Thus, the flow of the hydraulic oil discharged by the right main pump 14R is restricted by the right throttle 18R. The right throttle 18R generates right control pressure for controlling the right regulator 13R.

A left control pressure sensor 19L detects left control pressure, and a detection signal corresponding to the detected left control pressure is taken into the controller 30. A right control pressure sensor 19R detects right control pressure, and a detection signal corresponding to the detected right control pressure is taken into the controller 30.

The controller 30 may control the left regulator 13L and adjust the discharge amount of the left main pump 14L according to the discharge pressure of the left main pump 14L detected by the left discharge pressure sensor 28L. For example, the controller 30 may reduce the discharge amount of the left main pump 14L by controlling the left regulator 13L and adjusting the swash plate inclination angle of the left main pump 14L according to an increase in the discharge pressure of the left main pump 14L. The same applies to the right regulator 13R. Thus, the controller 30 can control a total horsepower of the main pump 14 such that absorbed horsepower of the main pump 14, which is represented by the product of the discharge pressure and the discharge amount, does not exceed the output horsepower of the engine 11.

The controller 30 may also control the left regulator 13L in accordance with the left control pressure detected by the left control pressure sensor 19L, thereby adjusting the discharge amount of the left main pump 14L. For example, the controller 30 decreases the discharge amount of the left main pump 14L as the left control pressure increases, and increases the discharge amount of the left main pump 14L as the left control pressure decreases. The same applies to the discharge amount of the right main pump 14R.

Specifically, in a standby state (a state illustrated in FIG. 3) in which no hydraulic actuator of the shovel 100 is operated, the hydraulic oil discharged from the left main pump 14L passes through the left central bypass oil path C1L and reaches the left throttle 18L. The flow of the hydraulic oil discharged from the left main pump 14L increases the left control pressure generated in the upstream of the left throttle 18L. As a result, the controller 30 reduces the discharge amount of the left main pump 14L to an allowable minimum discharge amount and suppresses a pressure loss (pumping loss) when the hydraulic oil discharged from the left main pump 14L passes through the left central bypass oil path C1L. The same applies to the pressure loss (pumping loss) when the hydraulic oil discharged from the right main pump 14R passes through the right central bypass oil path C1R.

Additionally, when any of the hydraulic actuators is operated through the operation device 26, the hydraulic oil discharged from the left main pump 14L flows into the hydraulic actuator to be operated through a control valve corresponding to the hydraulic actuator to be operated. Accordingly, due to a direction of the flow, the mount of the hydraulic oil discharged from the left main pump 14L and reaching the left throttle 18L is decreased or disappears, thereby reducing the left control pressure generated in the upstream of the left throttle 18L. As a result, the controller 30 increases the discharge amount of the left main pump 14L, circulates sufficient hydraulic oil to the hydraulic actuator to be operated, and can reliably drive the hydraulic actuator to be operated. The same applies to the hydraulic oil discharged from the right main pump 14R.

Figure 4A:
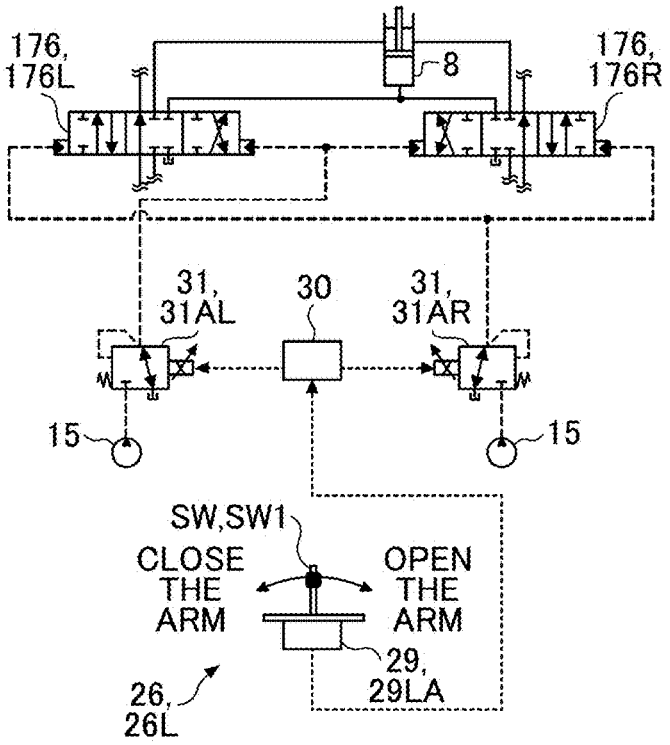
FIG. 4A is a partial view of a hydraulic system for arm cylinder operation.
Figure 4B:
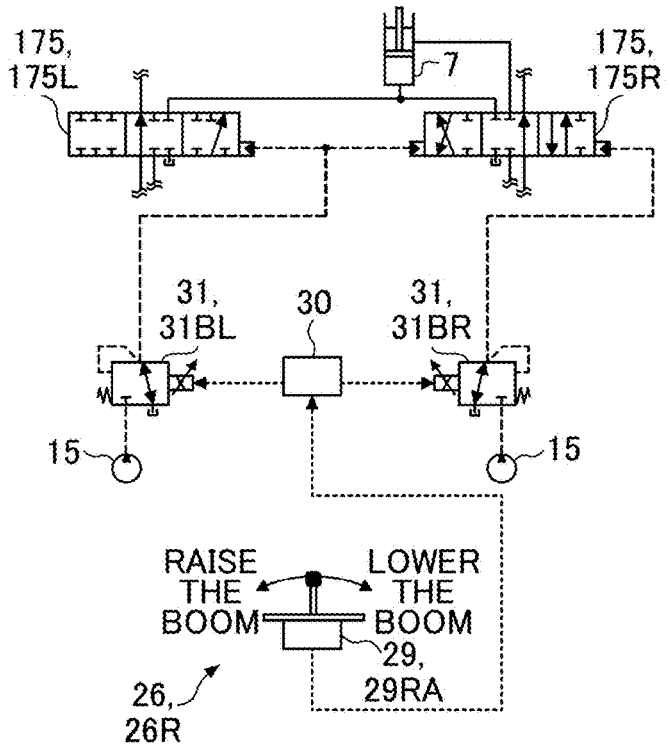
FIG. 4B is a partial view of a hydraulic system for boom cylinder operation.
Figure 4C:
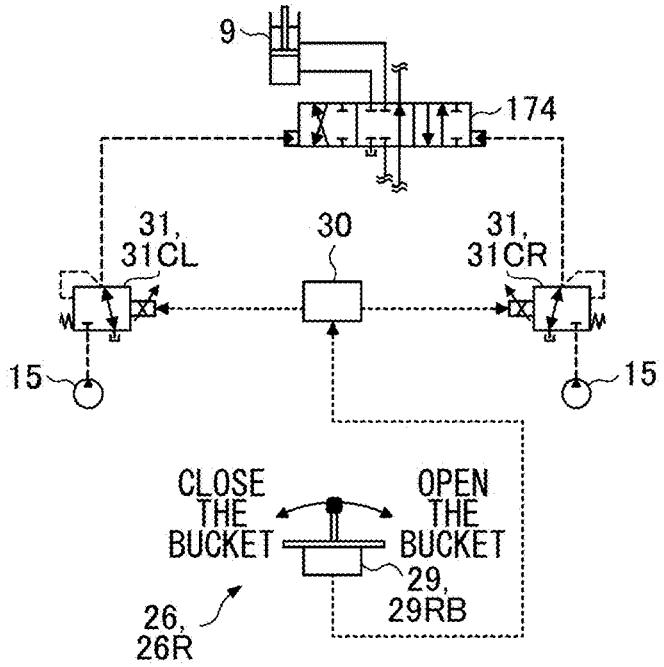
FIG. 4C is a partial view of a hydraulic system for bucket cylinder operation.
Figure 4D:
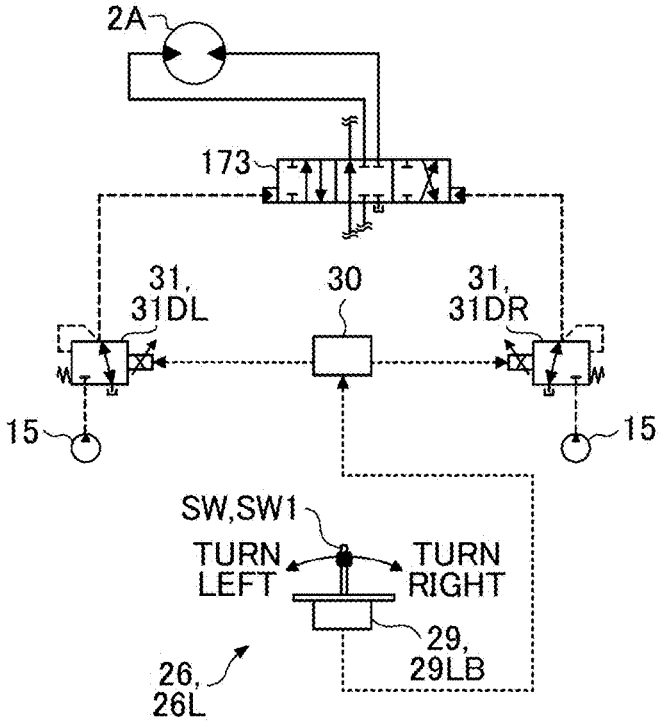
FIG. 4D is a partial view of a hydraulic system for turning hydraulic motor operation.
Figure 4E:
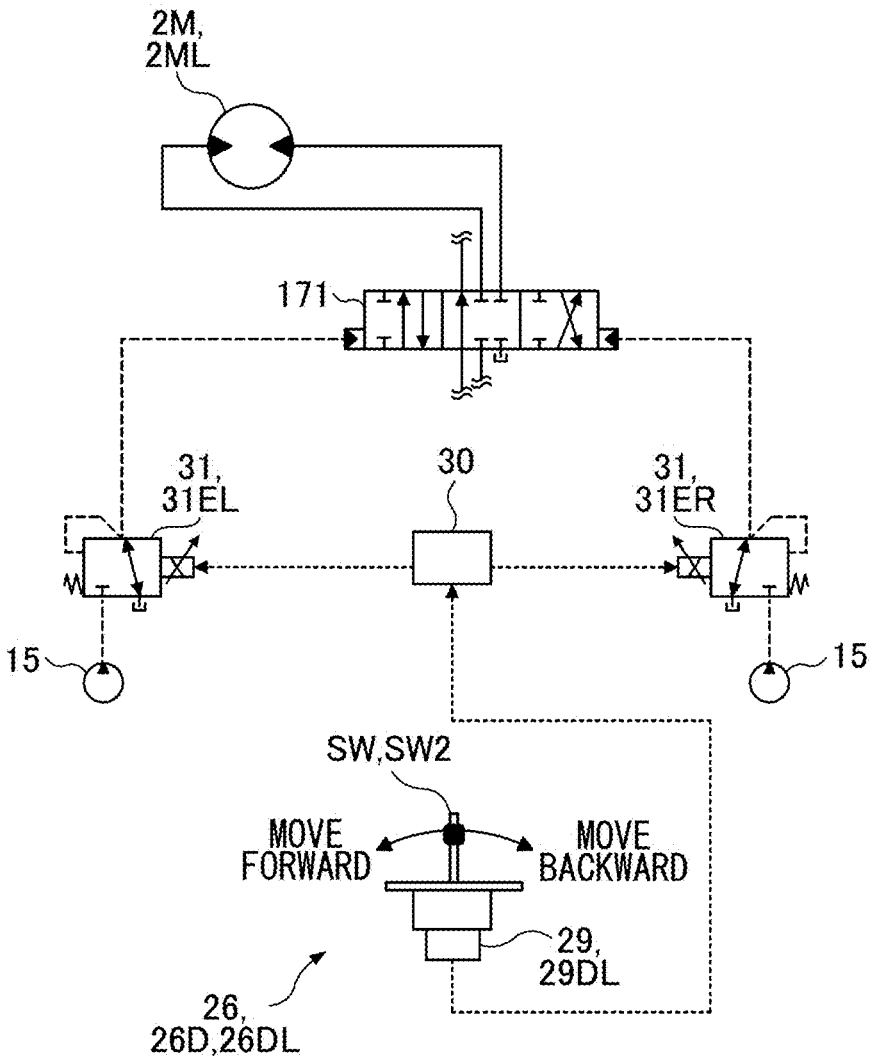
FIG. 4E is a partial view of a hydraulic system for left running hydraulic motor operation.
Figure 4F:
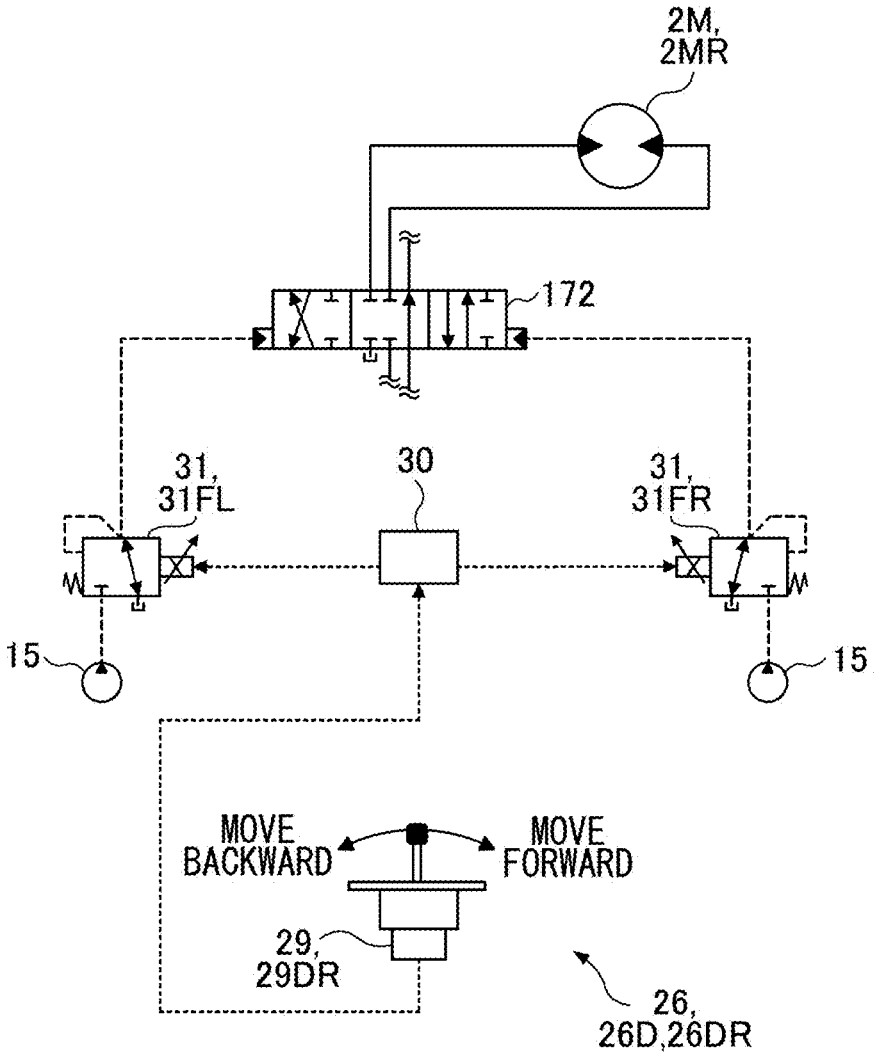
FIG. 4F is a partial view of a hydraulic system for right running hydraulic motor operation.

Next, the configuration in which the controller 30 operates the actuators will be described with reference to FIGS. 4A to 4F. FIGS. 4A to 4F are views in which a part of the hydraulic system is extracted. Specifically, FIG. 4A is a view in which a part of the hydraulic system relating to the operation of the arm cylinder 8 is extracted, and FIG. 4B is a view in which a part of the hydraulic system relating to the operation of the boom cylinder 7 is extracted. FIG. 4C is view in which a part of the hydraulic system relating to the operation of the bucket cylinder 9 is extracted, and FIG. 4D is a view in which a part of hydraulic system relating to the operation of the swivel hydraulic motor 2A is extracted. FIG. 4E is a view in which a part of the hydraulic system relating to the operation of the left traveling hydraulic motor 2ML is extracted, and FIG. 4F is a view in which a part of the hydraulic system relating to the operation of the right traveling hydraulic motor 2MR is extracted.

As illustrated in FIGS. 4A to 4F, the hydraulic system includes the solenoid valve 31. The solenoid valve 31 includes the solenoid valve 31AL to the solenoid valve 31FL and the solenoid valve 31AR to the solenoid valve 31FR.

The solenoid valve 31 is disposed in a conduit connecting the pilot pump 15 and the pilot port of the corresponding control valve in the control valve group 17, and is configured to change the flow area of the conduit by changing the opening area of the solenoid valve 31. In the present embodiment, the solenoid valve 31 is a solenoid proportional valve and operates in response to control commands output by the controller 30. Therefore, the controller 30 can supply the pilot oil discharged from the pilot pump 15 to the pilot port of the corresponding control valve in the control valve group 17 via the solenoid valve 31 in response to the operation of the operation device 26 by the operator or independently of the operation of the operation device 26 by the operator. The controller 30 can cause the pilot pressure generated by the solenoid valve 31 to act on the pilot port of the corresponding control valve.

With this configuration, the controller 30 can operate the hydraulic actuator corresponding to the specific operation device 26 not only when the specific operation device 26 is operated but also when the specific operation device 26 is not operated. Also, the controller 30 can forcibly stop the operation of the hydraulic actuator corresponding to the specific operation device 26 even when the specific operation device 26 is operated.

For example, as illustrated in FIG. 4A, the left operation lever 26L is used to operate the arm 5. Specifically, the left operation lever 26L uses the pilot oil discharged from the pilot pump 15 to apply a pilot pressure corresponding to an operation in the longitudinal direction to the pilot port of the control valve 176. More specifically, when the left operation lever 26L is operated in the arm closing direction (rear direction), a pilot pressure corresponding to an operation amount is applied to the right pilot port of the control valve 176L and the left pilot port of the control valve 176R. When the left operation lever 26L is operated in an arm opening direction (front direction), a pilot pressure corresponding to an operation amount is applied to the left pilot port of the control valve 176L and the right pilot port of the control valve 176R.

The operation device 26 is provided with a switch SW. In the present embodiment, the switch SW includes a switch SW1 and a switch SW2. The switch SW1 is an MC switch (push button switch) provided at the tip of the left operation lever 26L. The operator can operate the left operation lever 26L while pressing the switch SW1. The switch SW1 may be provided at the right operation lever 26R or at another position in the cab 10. The switch SW2 is the MC switch (push button switch) provided at the tip of the left traveling lever 26DL. The operator can operate the left traveling lever 26DL while pressing the switch SW2. The switch SW2 may be provided at the right traveling lever 26DR or at another position in the cab 10.

The operation sensor 29LA detects the contents of the operator's operation of the left operation lever 26L in the longitudinal direction and outputs a detected value to the controller 30.

The solenoid valve 31AL operates in response to a control command (current command) output from the controller 30. Then, the pilot pressure by the pilot oil that flows from the pilot pump 15 to the right pilot port of the control valve 176L and the left pilot port of the control valve 176R through the solenoid valve 31AL is adjusted. The solenoid valve 31AR operates in response to a control command (current command) output from the controller 30. Then, the pilot pressure by the pilot oil that flows from the pilot pump 15 to the left pilot port of the control valve 176L and the right pilot port of the control valve 176R through the solenoid valve 31AR is adjusted. The solenoid valve 31AL can adjust the pilot pressure such that the control valve 176L and the control valve 176R can be adjusted to desired positions. Similarly, the solenoid valve 31AR can adjust the pilot pressure such that the control valve 176L and the control valve 176R can be adjusted to desired positions.

With this configuration, the controller 30 can supply the pilot oil discharged from the pilot pump 15 to the right pilot port of the control valve 176L and the left pilot port of the control valve 176R through the solenoid valve 31AL in response to the arm-closing operation by the operator. The controller 30 can also supply the pilot oil discharged from the pilot pump 15 to the right pilot port of the control valve 176L and the left pilot port of the control valve 176R through the solenoid valve 31AL independently of the arm-closing operation by the operator. That is, the controller 30 can close the arm 5 in response to the arm-closing operation by the operator or independently of the arm-closing operation by the operator. As described above, the solenoid valve 31AL functions as the "arm solenoid valve" or the "arm-closing solenoid valve".

Furthermore, the controller 30 can supply the pilot oil discharged from the pilot pump 15 to the left pilot port of the control valve 176L and the right pilot port of the control valve 176R through the solenoid valve 31AR in response to an arm-opening operation by the operator. Also, the controller 30 can supply the pilot oil discharged from the pilot pump 15 to the left pilot port of the control valve 176L and the right pilot port of the control valve 176R through the solenoid valve 31AR independently of the arm-opening operation by the operator. That is, the controller 30 can open the arm 5 in response to the arm-opening operation by the operator or independently of the arm-opening operation by the operator. Thus, the solenoid valve 31AR functions as the "arm solenoid valve" or the "arm-opening solenoid valve".

With this configuration, the controller 30 can lower the pilot pressure acting on the pilot port on the closing side of the control valve 176 (the left pilot port of the control valve 176L and the right pilot port of the control valve 176R) as necessary to forcibly stop the closing operation of the arm 5 even when the arm-closing operation is being performed by the operator. The same applies to the case where the opening operation of the arm 5 is forcibly stopped while the arm-opening operation is being performed by the operator.

Alternatively, even when the arm-closing operation is performed by the operator, the controller 30 may forcibly stop the closing operation of the arm 5 by controlling the solenoid valve 31AR, increasing the pilot pressure acting on the pilot port on the opening side of the control valve 176 (the right pilot port of the control valve 176L and the left pilot port of the control valve 176R) located on the opposite side of the pilot port on the closing side of the control valve 176, and forcibly returning the control valve 176 to the neutral position. The same applies to the case where the opening operation of the arm 5 is forcibly stopped when the arm-opening operation is performed by the operator.

The same applies to the case where the operation of the boom 4 is forcibly stopped when the boom-raising operation or a boom-lowering operation is performed by the operator, the case where the operation of the bucket 6 is forcibly stopped when a bucket-closing operation or the bucket-opening operation is performed by the operator, and the case where the turn operation of the upper swivel body 3 is forcibly stopped when the turn operation is performed by the operator, although the description thereof with reference to FIGS. 4B to 4F below will be omitted. The same applies to the case where the traveling operation of the lower traveling body 1 is forcibly stopped when the traveling operation is performed by the operator.

In order to improve responsiveness of the arm operation (the arm-closing operation and the arm-opening operation), the controller 30 may be configured to apply a minute pilot pressure to the pilot ports on both sides of the control valve 176 before the arm operation is performed. The same applies to other operations such as the boom operation (the boom-raising operation and the boom-lowering operation). That is, the controller 30 can improve the responsiveness of the hydraulic actuators by using more pilot oil.

As illustrated in FIG. 4B, the right operation lever 26R is used to operate the boom 4. Specifically, the right operation lever 26R uses the pilot oil discharged from the pilot pump 15 to apply a pilot pressure corresponding to an operation in the longitudinal direction to the pilot port of the control valve 175. More specifically, when the right operation lever 26R is operated in a boom-raising direction (rear direction), a pilot pressure corresponding to an operation amount is applied to the right pilot port of the control valve 175L and the left pilot port of the control valve 175R. When the right operation lever 26R is operated in a boom-lowering direction (front direction), a pilot pressure corresponding to an operation amount is applied to the right pilot port of the control valve 175R.

The operation sensor 29RA detects the contents of the operation of the right operation lever 26R in the longitudinal direction by the operator and outputs a detected value to the controller 30.

A solenoid valve 31BL operates in response to a control command (current command) output from the controller 30. The pilot pressure is adjusted by pilot oil that flows from the pilot pump 15 to the right pilot port of the control valve 175L and the left pilot port of the control valve 175R via the solenoid valve 31BL. A solenoid valve 31BR operates in response to a control command (current command) output from the controller 30. Then, the pilot pressure by the pilot oil that flows from the pilot pump 15 to the right pilot port of the control valve 175R through the solenoid valve 31BR is adjusted. The solenoid valve 31BL can adjust the pilot pressure such that the control valve 175L and the control valve 175R can be adjusted to desired positions. The solenoid valve 31BR can adjust the pilot pressure such that the control valve 175R can be adjusted to a desired position.

With this configuration, the controller 30 can supply the pilot oil discharged from the pilot pump 15 to the right pilot port of the control valve 175L and the left pilot port of the control valve 175R through the solenoid valve 31BL in response to the boom-raising operation by the operator. The controller 30 can also supply the pilot oil discharged from the pilot pump 15 to the right pilot port of the control valve 175L and the left pilot port of the control valve 175R through the solenoid valve 31BL independently of the boom-raising operation by the operator. That is, the controller 30 can raise the boom 4 in response to the boom-raising operation by the operator or independently of the boom-raising operation by the operator. Thus, the solenoid valve 31BL functions as a "boom-raising solenoid valve" or a "boom-raising solenoid valve".

The controller 30 can also supply the pilot oil discharged from the pilot pump 15 to the right pilot port of the control valve 175R through the solenoid valve 31BR in response to the boom-lowering operation by the operator. Also, the controller 30 can supply the pilot oil discharged from the pilot pump 15 to the right pilot port of the control valve 175R via the solenoid valve 31BR independently of the boom-lowering operation by the operator. That is, the controller 30 can lower the boom 4 in response to the boom-lowering operation by the operator or independently of the boom-lowering operation by the operator. Thus, the solenoid valve 31BR functions as a "boom solenoid valve" or a "boom-lowering solenoid valve".

As illustrated in FIG. 4C, the right operation lever 26R is also used to operate the bucket 6. Specifically, the right operation lever 26R uses the pilot oil discharged from the pilot pump 15 to apply a pilot pressure corresponding to the operation in the lateral direction to the pilot port of the control valve 174. More specifically, when the right operation lever 26R is operated in a bucket closing direction (leftward direction), the pilot pressure corresponding to the operation amount is applied to the left pilot port of the control valve 174. When the right operation lever 26R is operated in a bucket opening direction (rightward direction), the pilot pressure corresponding to the operation amount is applied to the right pilot port of the control valve 174.

The operation sensor 29RB detects the contents of the operation of the right operation lever 26R in the lateral direction by the operator, and outputs a detected value to the controller 30. When the bucket angle sensor S3 is omitted, the controller 30 may estimate the bucket angle based on the output of the operation sensor 29RB.

A solenoid valve 31CL operates in response to a control command (current command) output from the controller 30. The solenoid valve 31CL adjusts the pilot pressure caused by the pilot oil that flows from the pilot pump 15 to the left pilot port of the control valve 174 via the solenoid valve 31CL. A solenoid valve 31CR operates in response to a control command (current command) output from the controller 30. The solenoid valve 31CR adjusts the pilot pressure caused by the pilot oil that flows from the pilot pump 15 to the right pilot port of the control valve 174 via the solenoid valve 31CR. The solenoid valve 31CL can adjust the pilot pressure such that the control valve 174 can be adjusted to a desired valve position. Similarly, the solenoid valve 31CR can adjust the pilot pressure such that the control valve 174 can be adjusted to a desired valve position.

With this configuration, the controller 30 can supply the pilot oil discharged from the pilot pump 15 to the left pilot port of the control valve 174 via the solenoid valve 31CL in response to the bucket-closing operation by the operator. Also, the controller 30 can supply the pilot oil discharged from the pilot pump 15 to the left pilot port of the control valve 174 via the solenoid valve 31CL independently of the bucket-closing operation by the operator. That is, the controller 30 can close the bucket 6 in response to the bucket-closing operation by the operator or independently of the bucket-closing operation by the operator. Thus, the solenoid valve 31CL functions as a "bucket solenoid valve" or a "bucket-closing solenoid valve".

Also, the controller 30 can supply the pilot oil discharged from the pilot pump 15 to the right pilot port of the control valve 174 via the solenoid valve 31CR in response to the bucket-opening operation by the operator. Also, the controller 30 can supply the pilot oil discharged from the pilot pump 15 to the right pilot port of the control valve 174 via the solenoid valve 31CR, independently of the bucket-opening operation by the operator. That is, the controller 30 can open the bucket 6 in response to the bucket-opening operation by the operator or independently of the bucket-opening operation by the operator. Thus, the solenoid valve 31CR functions as a "bucket solenoid valve" or a "bucket-opening solenoid valve".

Furthermore, as illustrated in FIG. 4D, the left operation lever 26L is also used to operate the turner 2. More specifically, the left operation lever 26L uses the pilot oil discharged from the pilot pump 15 to apply a pilot pressure corresponding to the operation in the lateral direction to the pilot port of the control valve 173. More specifically, when the left operation lever 26L is operated in a leftward turning direction (leftward direction), the left pilot port of the control valve 173 is operated with a pilot pressure corresponding to the operation amount. When the left operation lever 26L is operated in a rightward turning direction (rightward direction), the right pilot port of the control valve 173 is operated with a pilot pressure corresponding to the operation amount.

The operation sensor 29 LB detects the contents of the leftward operation of the left operation lever 26L by the operator and outputs a detected value to the controller 30.

A solenoid valve 31DL operates in response to a control command (current command) output from the controller 30. The pilot pressure by the pilot oil that flows from the pilot pump 15 to the left pilot port of the control valve 173 through the solenoid valve 31DL is adjusted. A solenoid valve 31DR operates in response to a control command (current command) output from the controller 30. The pilot pressure by the pilot oil that flows from the pilot pump 15 to the right pilot port of the control valve 173 through the solenoid valve 31DR is adjusted. The solenoid valve 31DL can adjust the pilot pressure such that the control valve 173 can be adjusted to a desired valve position. Similarly, the solenoid valve 31DR can adjust the pilot pressure such that the control valve 173 can be adjusted to a desired valve position.

With this configuration, the controller 30 can supply the pilot oil discharged from the pilot pump 15 to the left pilot port of the control valve 173 through the solenoid valve 31DL in response to a left-turn operation by the operator. The controller 30 can also supply the pilot oil discharged from the pilot pump 15 to the left pilot port of the control valve 173 through the solenoid valve 31DL independently of the left-turn operation by the operator. That is, the controller 30 can turn the turner 2 to the left in response to the left-turn operation by the operator or independently of the left-turn operation by the operator. In this way, the solenoid valve 31DL functions as a "turning solenoid valve" or a "left-turning solenoid valve".

The controller 30 can also supply the pilot oil discharged from the pilot pump 15 to the right pilot port of the control valve 173 through the solenoid valve 31DR in response to the right-turn operation by the operator. The controller 30 can also supply the pilot oil discharged from the pilot pump 15 to the right pilot port of the control valve 173 through the solenoid valve 31DR independently of the right-turn operation by the operator. That is, the controller 30 can turn the turner 2 to the right in response to the right-turn operation by the operator or independently of the right-turn operation by the operator. Thus, the solenoid valve 31DR functions as a "turning solenoid valve" or a "right-turning solenoid valve".

As illustrated in FIG. 4E, the left traveling lever 26DL is used to operate a left crawler 1CL. Specifically, the left traveling lever 26DL uses the pilot oil discharged from the pilot pump 15 to apply a pilot pressure corresponding to an operation in the longitudinal direction to the pilot port of the control valve 171. More specifically, when the left traveling lever 26DL is operated in the forward direction (front direction), the pilot pressure corresponding to an operation amount is applied to the left pilot port of the control valve 171. When the left traveling lever 26DL is operated in the backward direction (rear direction), the pilot pressure corresponding to an operation amount is applied to the right pilot port of the control valve 171.

The operation sensor 29DL electrically detects contents of the operation of the left traveling lever 26DL in the longitudinal direction by the operator, and outputs a detected value to the controller 30.

A solenoid valve 31EL operates in response to a current command output from the controller 30. The solenoid valve 31EL adjusts pilot pressure caused by the pilot oil that flows from the pilot pump 15 to the left pilot port of the control valve 171 via the solenoid valve 31EL. A solenoid valve 31ER operates in response to a current command output from the controller 30. The solenoid valve 31ER adjusts pilot pressure caused by the pilot oil that flows from the pilot pump 15 to the right pilot port of the control valve 171 via the solenoid valve 31ER. The solenoid valves 31EL and 31ER can adjust pilot pressure such that the control valve 171 can be adjusted to a desired valve position.

With this configuration, the controller 30 can supply the pilot oil discharged from the pilot pump 15 to the left pilot port of the control valve 171 via the solenoid valve 31EL independently of the left forward operation by the operator. That is, the left crawler 1CL can be moved forward. The controller 30 can also supply the pilot oil discharged from the pilot pump 15 to the right pilot port of the control valve 171 via the solenoid valve 31ER independently of the left backward operation by the operator. That is, the left crawler 1CL can be moved backward. Thus, the solenoid valve 31EL functions as a "left traveling solenoid valve" or a "left advancing solenoid valve", and the solenoid valve 31ER functions as a "left traveling solenoid valve" or the "left backward solenoid valve".

As illustrated in FIG. 4F, the right traveling lever 26DR is used to operate a right crawler 1CR. Specifically, the right traveling lever 26DR uses the pilot oil discharged from the pilot pump 15 to apply a pilot pressure corresponding to an operation in the longitudinal direction to the pilot port of the control valve 172. More specifically, when the right traveling lever 26DR is operated in the forward direction (front direction), a pilot pressure corresponding to an operation amount is applied to the right pilot port of the control valve 172. When the right traveling lever 26DR is operated in the backward direction (rear direction), a pilot pressure corresponding to an operation amount is applied to the left pilot port of the control valve 172.

The operation sensor 29DR electrically detects the contents of the operation of the right traveling lever 26DR in the longitudinal direction by the operator, and outputs the detected value to the controller 30.

The solenoid valve 31FL operates in response to a current command output from the controller 30. The solenoid valve 31FL adjusts pilot pressure caused by the pilot oil that flows from the pilot pump 15 to the left pilot port of the control valve 172 via the solenoid valve 31FL. The solenoid valve 31FR operates in response to a current command output from the controller 30. The solenoid valve 31FR adjusts pilot pressure caused by the pilot oil that flows from the pilot pump 15 to the right pilot port of the control valve 172 via the solenoid valve 31FR. The solenoid valves 31FL and 31FR can adjust pilot pressure such that the control valve 172 can be adjusted to a desired valve position.

With this configuration, the controller 30 can supply the pilot oil discharged from the pilot pump 15 to the right pilot port of the control valve 172 via the solenoid valve 31FR independently of the operator's right forward operation. That is, the right crawler 1CR can be moved forward. The controller 30 can also supply the pilot oil discharged from the pilot pump 15 to the left pilot port of the control valve 172 via the solenoid valve 31FL independently of the operator's right backward operation. That is, the right crawler 1CR can be moved backward. Thus, the solenoid valve 31FR functions as a "right traveling solenoid valve" or the "right advancing solenoid valve", and the solenoid valve 31FL functions as the "right traveling solenoid valve" or the "right backward solenoid valve".

The shovel 100 may also have a configuration for automatically operating the bucket tilt mechanism. In this case, the hydraulic system portion relating to a bucket tilt cylinder included in the bucket tilt mechanism may be configured in the same manner as the hydraulic system portion relating to the operation of the boom cylinder 7.

Furthermore, although the electric operation lever is described as an example of the operation device 26, a hydraulic operation lever may be employed instead of the electric operation lever. In this case, an operation amount of the hydraulic operation lever may be detected in the form of pressure by a pressure sensor and input to the controller 30. The solenoid valve may be arranged between the operation device 26 as the hydraulic operation lever and the pilot port of each control valve. The solenoid valve is configured to operate in response to an electric signal from the controller 30. With this configuration, when a manual operation by using the operation device 26 as the hydraulic operation lever is performed, the operation device 26 can move each control valve by increasing or decreasing the pilot pressure according to an operation amount. Each control valve may be configured as a solenoid spool valve. In this case, the electromagnetic spool valve operates in response to an electric signal from the controller 30 corresponding to the operation amount of the electric operation lever.

Figure 5:
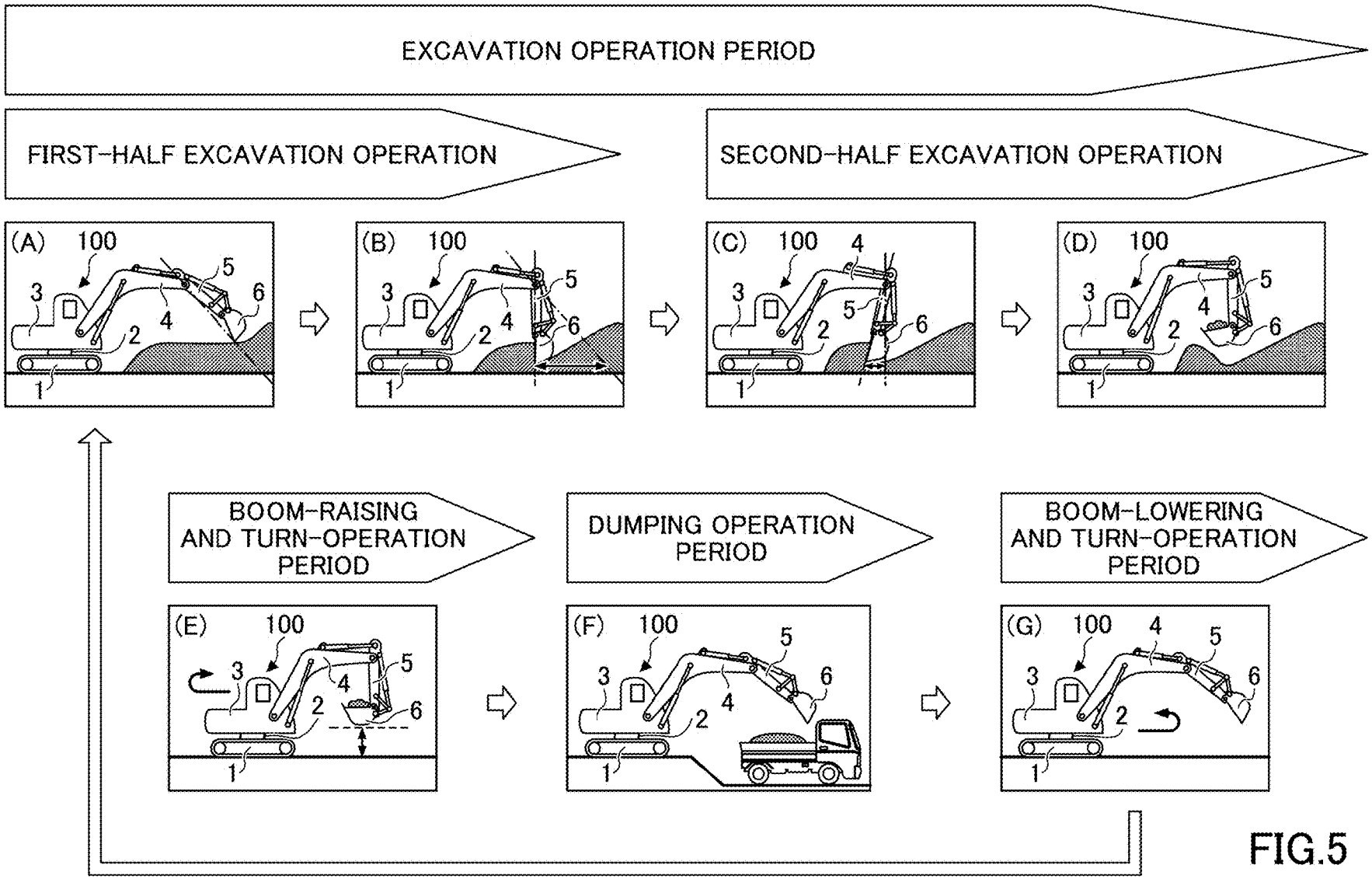
FIG. 5 is a diagram for describing a flow of a loading operation by a shovel.

Next, the flow of a loading operation by the shovel 100 will be described with reference to FIG. 5. FIG. 5 is a diagram for explaining a flow of the loading operation by the shovel 100.

Illustrations (A) to (D) in FIG. 5 are for describing a flow of the excavation operation. A period during which the excavation operation is performed is referred to as an excavation operation period. The excavation operation is divided into a first half of the excavation operation, as illustrated in (A) and (B) in FIG. 5, and a second half of the excavation operation, as illustrated in (C) and (D) in FIG. 5.

As illustrated in (A) in FIG. 5, the operator of the shovel 100 moves the tip of the bucket 6 such that the tip of the bucket 6 is at a desired height position with respect to an excavation target (earth and sand, in this example), and closes the arm 5 from an open state as illustrated in (A) in FIG. 5 until the position of the arm 5 becomes substantially perpendicular to the ground as illustrated in (B) in FIG. 5. By this operation, the earth and sand up to a certain depth are excavated, and the earth and sand are raked until the arm 5 becomes substantially perpendicular to the ground surface. The above operation is referred to as the first half of the excavation operation, and a period of which is referred to as a first-half period of the excavation operation.

Thereafter, as illustrated in (C) in FIG. 5, the operator further closes the arm 5 and rakes the earth and sand even further by the bucket 6. Then, as illustrated in (D) in FIG. 5, the operator closes the bucket 6 until an upper edge thereof becomes substantially horizontal, and takes the raked earth and sand into the bucket 6. Furthermore, the operator raises the boom 4 and raises the bucket 6 to a position as illustrated in (D) in FIG. 5. The above operations are referred to as the second half of the excavation operation, and a period of which is referred to as a second-half period of the excavation operation. The operation as illustrated in (C) in FIG. 5 may be a combined operation of the arm 5 and the bucket 6, or may be a combined operation of the boom 4, the arm 5, and the bucket 6.

Next, with the upper edge of the bucket 6 kept substantially horizontal, the operator raises the boom 4 until a bottom surface of the bucket 6 reaches a desired height from the ground as illustrated in (E) in FIG. 5. The desired height is, for example, not less than the height of a rear gate of a dump truck. After or at the same time as this operation, the operator rotates the upper swivel body 3 as indicated by an arrow to move the bucket 6 to a position to discharge (dump) earth and sand.

When a boom-raising and turn operation is completed, the operator opens the arm 5 and the bucket 6 as illustrated in (F) in FIG. 5 to discharge (dump) earth and sand in the bucket 6 to the bed of the dump truck, the ground, or the like. In this earth and sand discharge operation (dumping operation), the operator may open only the bucket 6 to discharge earth and sand, or may open the arm 5 and the bucket 6 to discharge earth and sand while lowering the boom 4.

When the dumping operation is completed, the operator rotates the upper swivel body 3 as indicated by an arrow as illustrated in (G) in FIG. 5 to move the bucket 6 directly above the excavation position. After that, the operator lowers the bucket 6 to a desired height as illustrated in (A) in FIG. 5 to perform the excavation operation again. The operator may lower the boom 4 to lower the bucket 6 to a desired height above the excavation target at the same time as the rotation.

In this manner, the controller 30 proceeds the loading operation by the shovel 100 while repeating a cycle (series of operations) including the "excavation operation", the "boom-raising and turn operation", the "dumping operation", and the "boom-lowering and turn operation".

Figure 6:
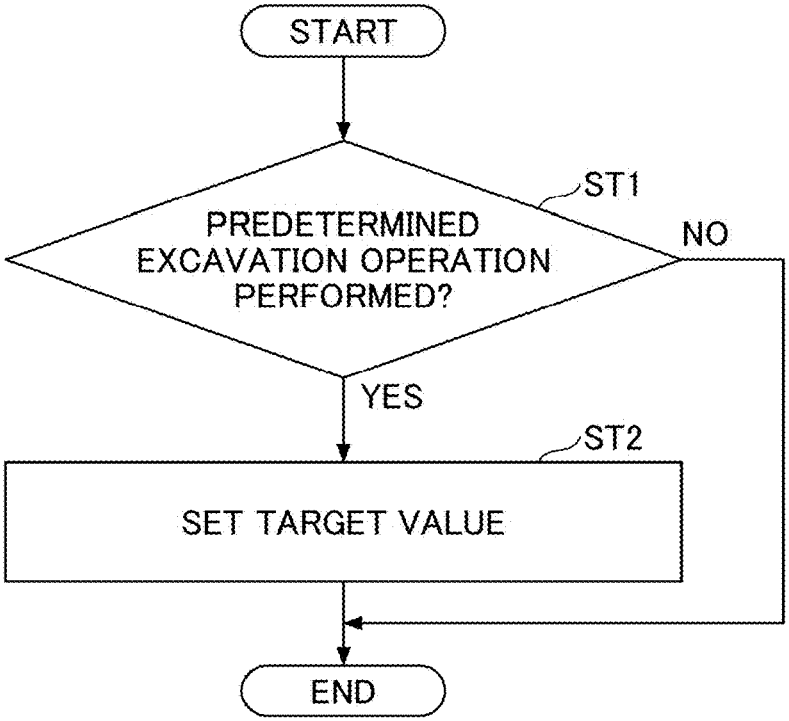
FIG. 6 is a flowchart illustrating an example of a setup processing flow.

Next, referring to FIG. 6, an example of a flow of processing (hereinafter, referred to as "setting processing") for setting a target value by the controller 30 will be described. FIG. 6 is a flowchart showing an example of the flow of the setting processing. In the illustrated example, the target specifier 56 of the controller 30 executes the setting processing every time the excavation operation is completed until the target value is set. Specifically, the target specifier 56 determines whether or not the excavation operation is completed based on outputs of the attitude sensor and the cylinder pressure sensor. The target specifier 56 executes the setting processing when it determines that the excavation operation is completed.

First, the target specifier 56 determines whether or not a predetermined excavation operation has been performed (step ST1). In the illustrated example, the target specifier 56 determines whether or not the amount of earth and sand taken into the bucket 6 is larger than a predetermined amount based on an image of the bucket 6 lifted into the air after the excavation operation captured by the camera S6F. Then, the target specifier 56 determines that the predetermined excavation operation has been performed when it can be determined that the amount of earth and sand taken into the bucket 6 is larger than the predetermined amount. For example, the target specifier 56 determines that the predetermined excavation operation has been performed when it can be determined that the bucket 6 is full of earth and sand. In contrast, the target specifier 56 determines that the predetermined excavation operation has not been performed when it cannot be determined that the amount of earth and sand taken into the bucket 6 is larger than a predetermined amount, that is, when it can be determined that the bucket 6 is not full of earth and sand. Note that even when it can be determined that the bucket 6 is full of earth and sand, the target specifier 56 may determine that the predetermined excavation operation has not been performed when it determines that the amount of earth and sand spilled from the bucket 6 when the bucket 6 is lifted is larger than a predetermined amount.

The target specifier 56 may determine that the predetermined excavation operation has been performed when a predetermined button is pressed. The predetermined button is a button pressed by the operator when the operator visually sees the inside of the bucket 6 lifted into the air after the excavation operation and determines that the bucket 6 is full of earth and sand. The operator may determine whether or not the bucket 6 is full of earth and sand by viewing the image captured by the camera S6F. In this case, the image captured by the camera S6F may be displayed on the display device 40.

When it is determined that the predetermined excavation operation has not been performed (NO in step ST1), the target specifier 56 terminates the current setting processing without setting a target value.

In contrast, when it is determined that the predetermined excavation operation has been performed (YES in step ST1), the target specifier 56 sets a target value (step ST2). In the illustrated example, the target specifier 56 sets as a target value a maximum value of the excavation reactive force calculated during the execution of the excavation operation determined to be the predetermined excavation operation. The target specifier 56 may set as a target value the maximum value of the horizontal component or the vertical component of the excavation reactive force calculated during the execution of the excavation operation determined to be the predetermined excavation operation. In this case, the target value is used for comparison with the horizontal component or the vertical component of the excavation reactive force calculated during the excavation operation performed subsequently.

Figure 7:
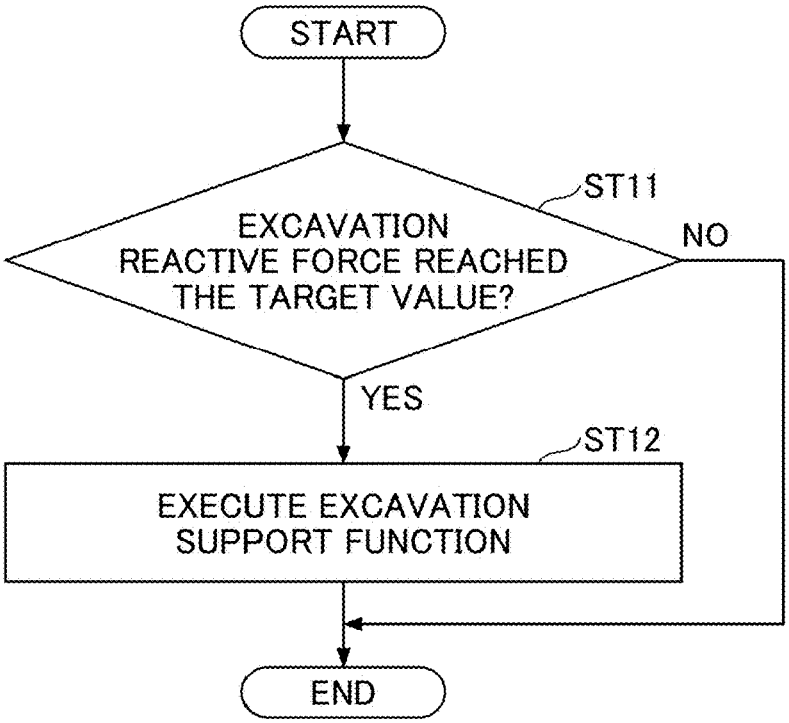
FIG. 7 is a flowchart illustrating an example of a support processing flow.

Next, with reference to FIG. 7, an example of a flow of processing (hereinafter, referred to as "support processing") in which the controller 30 supports the excavation operation will be described. FIG. 7 is a flowchart showing an example of a flow of the support processing. In the illustrated example, the excavation supporting part 57 of the controller 30 repeatedly executes the support processing at a predetermined control cycle during the excavation operation. More specifically, the excavation supporting part 57 determines whether or not an excavation operation is being performed based on outputs of the attitude sensor and the cylinder pressure sensor. More specifically, the excavation supporting part 57 determines that the excavation operation is started when the excavation reactive force repeatedly calculated by the excavation reactive force calculator 55 in the predetermined control cycle exceeds a predetermined start determination value. After determining that the excavation operation is started, the excavation supporting part 57 determines that the excavation operation is finished when the excavation reactive force repeatedly calculated by the excavation reactive force calculator 55 in the predetermined control cycle falls below a predetermined end determination value. Each of the start determination value and the end determination value is determined according to the attitude of the attachment. The excavation supporting part 57 repeatedly executes this support processing from the time when it determines that the excavation operation is started until it determines that the excavation operation is finished. The excavation supporting part 57 may make various determinations based on the magnitude of the horizontal component or the vertical component of the excavation reactive force repeatedly calculated by the excavation reactive force calculator 55 in a predetermined control cycle. In this case, each of the start determination value and the end determination value is a value corresponding to the magnitude of the horizontal component or the vertical component of the excavation reactive force.

First, the excavation supporting part 57 determines whether or not the excavation reactive force has reached a target value (step ST11). In the illustrated example, the excavation supporting part 57 determines whether or not the excavation reactive force calculated by the excavation reactive force calculator 55 has reached a target value set by the target specifier 56. When the target specifier 56 has not yet set the target value, that is, when the target value remains at an initial value (a maximum value that the excavation reactive force can take), the excavation supporting part 57 determines that the excavation reactive force has not reached the target value. The excavation supporting part 57 may be configured not to execute the support processing until the target value is set.

When it is determined that the excavation reactive force has reached the target value (YES in step ST11), the excavation supporting part 57 executes an excavation support function (step ST12). In the illustrated example, the excavation support function is a function to notify the operator of the shovel 100 that the excavation reactive force has reached the target value. Specifically, the excavation supporting part 57 outputs a control command to the display device 40 to cause the display device 40 to display image information indicating that the excavation reactive force has reached the target value, or outputs a control command to the sound output device 43 to cause the sound output device 43 to output sound information indicating that the excavation reactive force has reached the target value. The information indicating that the excavation reactive force has reached the target value may be, for example, information instructing the start of the boom-raising operation. By receiving such information, the operator of the shovel 100 can start the boom-raising operation at appropriate timing. As a result, for example, the operator can achieve a state in which the bucket 6 is fully loaded with earth and sand at the end of each excavation operation. That is, the controller 30 can achieve an excavation amount without excess or deficiency in each excavation operation, and consequently, the working efficiency of the shovel 100 can be enhanced.

In contrast, when it is determined that the excavation reactive force has not reached the target value (NO in step ST11), the excavation supporting part 57 terminates the current support processing without executing the excavation support function.

The excavation supporting part 57 may be configured to execute another excavation support function when it is determined that the excavation reactive force has not reached the target value. The other excavation support function is, for example, a machine guidance function or a machine control function. Specifically, the excavation supporting part 57 may be configured to automatically operate at least one of the boom cylinder 7 or the bucket cylinder 9 such that the control point set at the toe of the bucket 6 moves horizontally toward the upper swivel body 3 when the arm-closing operation is performed with the MC switch pressed. With this configuration, the operator of the shovel 100 can execute the excavation operation by moving the toe of the bucket 6 horizontally so as to approach the shovel 100 while the toe of the bucket 6 is at a desired depth under the ground. Then, when the operator is informed that the excavation reactive force has reached the target value, the operator performs the boom-raising operation so as to achieve the excavation amount without excess or deficiency.

Figure 8:
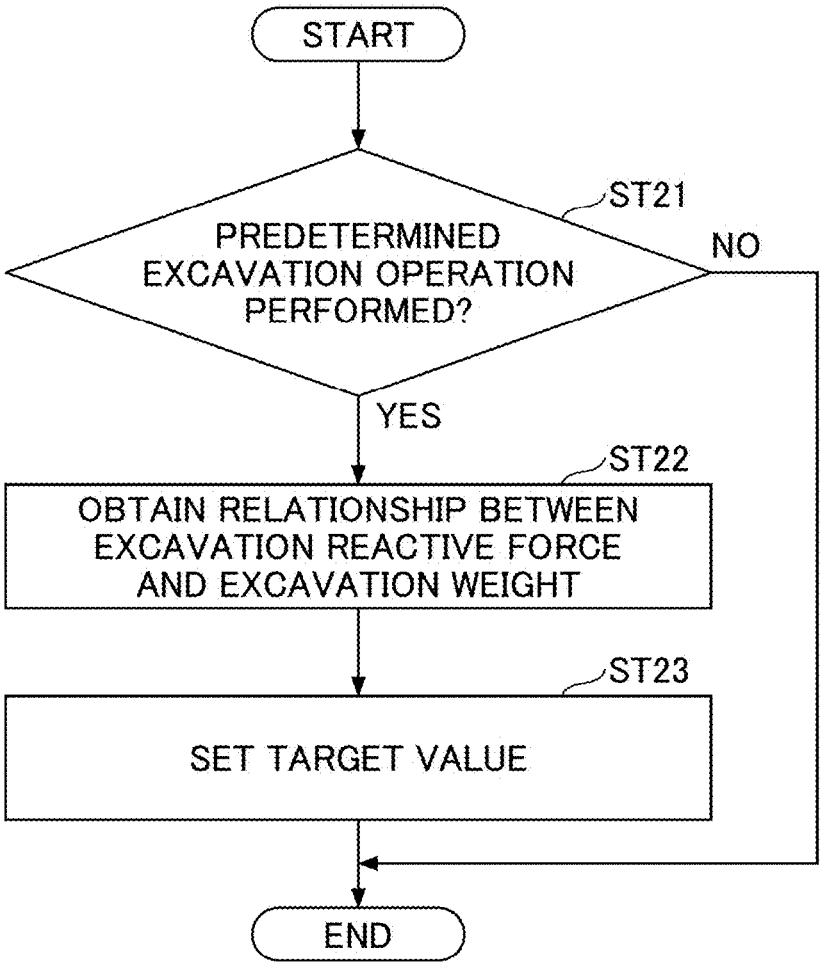
FIG. 8 is a flowchart illustrating another example of the setup processing flow.
Figure 9:
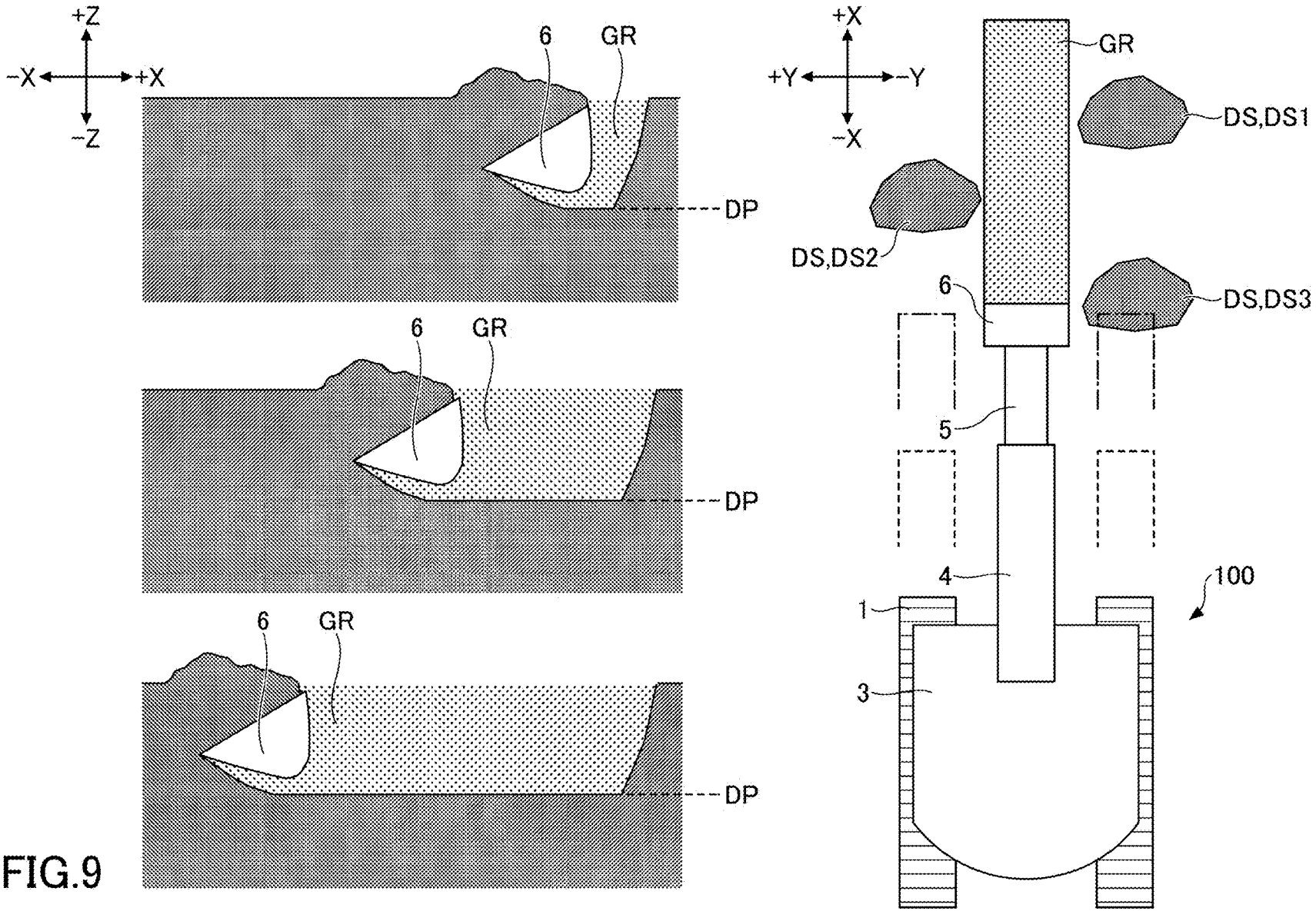
FIG. 9 is a diagram of a shovel for excavating a trench.

Next, another example of the flow of the setting processing will be described with reference to FIGS. 8 and 9. FIG. 8 is a flowchart showing another example of the flow of the setting processing. FIG. 9 is a diagram illustrating the shovel 100 excavating a groove GR. Specifically, left figures (upper left, middle left, and lower left figures) of FIG. 9 are cross-sectional views of the ground to be excavated, and the right figure of FIG. 9 is a top view of the shovel 100 excavating the groove GR. The upper left figure of FIG. 9 illustrates a state when the second half of the first excavation operation is started, the middle left figure of FIG. 9 illustrates a state when the second half of the second excavation operation is started, and the lower left figure of FIG. 9 illustrates a state when the second half of a third excavation operation is started.

In the example illustrated in FIGS. 8 and 9, the target specifier 56 of the controller 30 executes the setting processing every time the excavation operation is completed until the target value is set. Specifically, the target specifier 56 determines whether or not the excavation operation is completed based on the outputs of the attitude sensor and the cylinder pressure sensor. The target specifier 56 executes the setting processing when it determines that the excavation operation is completed.

In the example illustrated in FIGS. 8 and 9, the operator of the shovel 100 discharges the excavated earth and sand DS (see the right figure in FIG. 9) to the ground surface around the groove GR while excavating the groove GR having the predetermined ground depth DP (see the left figure in FIG. 9). For explanation, the right figure of FIG. 9 illustrates earth and sand DS1 excavated and removed by the first excavation operation, earth and sand DS2 excavated and removed by the second excavation operation, and earth and sand DS3 excavated and removed by the third excavation operation. As illustrated in the left figures of FIG. 9, in each excavation operation, the operator of the shovel 100 excavates the groove GR while making the toe of the bucket 6 reach a predetermined ground depth DP and horizontally moving the bucket 6 by a desired excavation length along the longitudinal direction (X-axis direction) of the groove GR. That is, the operator can excavate the groove GR while moving the toe of the bucket 6 substantially in the same path (when parallelly shifted) in each excavation operation, and can increase or decrease the weight of the earth and sand excavated in each excavation operation by extending or shortening the excavation length. This means that when the excavation length is the same, the weight of the earth and sand excavated becomes substantially the same. The operator may also perform the traveling operation of the lower traveling body 1 at a timing between the previous excavation operation and the current excavation operation. In the right figure of FIG. 9, for the purpose of explanation, positions of the front-end portions of the lower traveling body 1 when the first excavation operation is performed are illustrated by a dot-and-dash line, positions of the front end portions of the lower traveling body 1 when the second excavation operation is performed are illustrated by a dashed line, and the lower traveling body 1 when the third excavation operation is performed is illustrated by a solid line.

First, the target specifier 56 determines whether or not the predetermined excavation operation has been performed (step ST21). The determination by the target specifier 56 is the same as the determination by the target specifier 56 in step ST1 of FIG. 6. The target specifier 56 may determine whether or not the predetermined excavation operation has been performed based on a transition of the excavation reactive force calculated during the execution of the current excavation operation and the amount of soil and sand taken into the bucket 6 by the current excavation operation. The same applies to step ST1 in FIG. 6.

When it is determined that the predetermined excavation operation has not been performed (NO in step ST21), the target specifier 56 terminates the current setting processing without setting a target value.

In contrast, when it is determined that the predetermined excavation operation has been performed (YES in step ST21), the target specifier 56 obtains a relationship between the excavation reactive force and the excavation weight (step ST22). In the illustrated example, the target specifier 56 generates a reference table in which the values of the plurality of excavation reactive forces are associated with the values of the plurality of excavation weights in a one-to-one relationship based on a maximum value of the excavation reactive force calculated during execution of the excavation operation determined to be the predetermined excavation operation and a calculated value of the weight (excavation weight) of the earth and sand taken into the bucket 6 by the excavation operation. In this case, the number of times the excavation operation determined to be the predetermined excavation operation is performed is preferably two or more times. The values of the plurality of excavation reactive forces may be values of the horizontal component or the vertical component of the plurality of excavation reactive forces.

Thereafter, the target specifier 56 sets a target value (step ST23). In the illustrated example, the target specifier 56 derives the value of the excavation reactive force corresponding to the value of the desired excavation weight from the reference table generated in step ST22, and sets the value of the excavation reactive force as a target value. The value of the desired excavation weight may be a value preset by the operator of the shovel 100, or may be a value automatically calculated based on various types of information.

In the example illustrated in FIGS. 8 and 9, the target specifier 56 obtains the relationship between the excavation reactive force and the excavation weight based on information obtained during an excavation operation performed at the same work site on the same day, and then sets the target value. However, the target specifier 56 may obtain the relationship between the excavation reactive force and the excavation weight based on information obtained during an excavation operation performed at the same work site on a different day, and then set a target value. Alternatively, the target specifier 56 may obtain the relationship between the excavation reactive force and the excavation weight based on information obtained during an excavation operation performed at another work site, and then set a target value.

Figure 10:
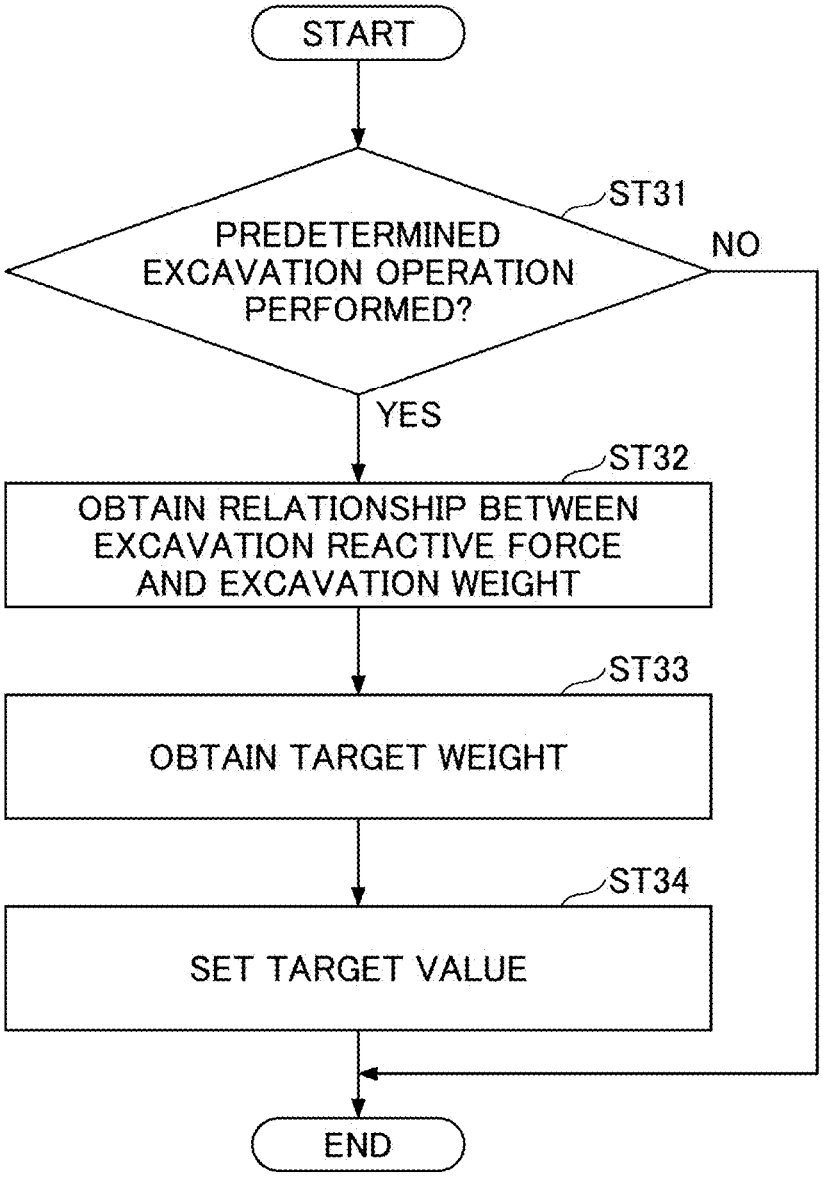
FIG. 10 is a flowchart illustrating yet another example of the setup processing flow.
Figure 11:
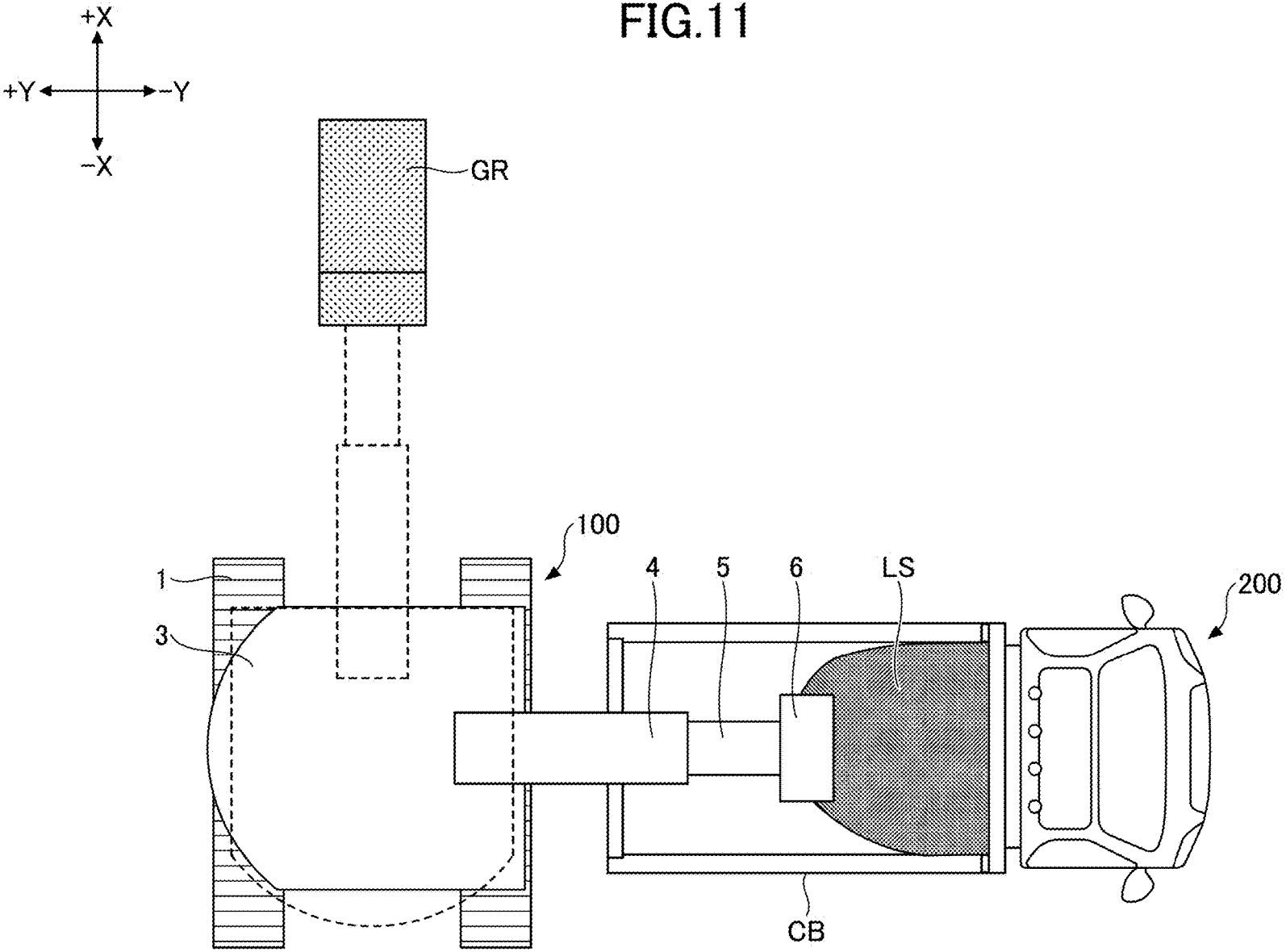
FIG. 11 is a top view of a shovel for loading earth and sand onto a dump truck.

Next, another example of the flow of the setting processing will be described with reference to FIGS. 10 and 11. FIG. 10 is a flowchart showing another example of the flow of the setting processing. FIG. 11 is a top view of the shovel 100 for excavating the groove GR and loading the excavated earth and sand onto a dump bed CB of a dump truck 200. Specifically, FIG. 11 is a diagram illustrating states of the shovel 100 and the dump truck 200 during the dumping operation after a fourth excavation operation. In FIG. 11, earth and sand LS loaded on the dump bed CB of the dump truck 200 by the loading operation including four excavation operations is illustrated. In FIG. 11, the state of the shovel 100 when the fourth excavation operation is completed is illustrated by a broken line. Incidentally, an excavation method of the groove GR in the example illustrated in FIG. 11 is the same as the method described with reference to FIG. 9.

In the examples illustrated in FIGS. 10 and 11, the target specifier 56 of the controller 30 executes the setting processing every time the excavation operation is completed until a target value is set. Specifically, the target specifier 56 determines whether or not the excavation operation is completed based on outputs of the attitude sensor and the cylinder pressure sensor. The target specifier 56 executes the setting process when it determines that the excavation operation is completed. In the example illustrated in FIG. 10, the excavated earth and sand are loaded onto the dump bed CB of the dump truck 200 while the shovel 100 excavates the groove GR of a predetermined ground depth DP. A maximum loading capacity of the dump truck 200 is 10 tons. In each excavation operation, the operator of the shovel 100 causes the toe of the bucket 6 to reach the predetermined ground depth DP and excavates the groove GR while horizontally moving the bucket 6 by a desired excavation length along the longitudinal direction of the groove GR. That is, in the first half of each excavation operation, the operator can excavate the groove GR while moving the toe of the bucket 6 substantially in the same path in each excavation operation, and can increase or decrease the weight of the earth and sand excavated in each excavation operation by extending or shortening the excavation length. The operator may also perform a traveling operation by the lower traveling body 1 at a timing between the previous excavation operation and the current excavation operation.

First, the target specifier 56 determines whether or not a predetermined excavation operation has been performed (step ST31). The determination by the target specifier 56 is the same as the determination by the target specifier 56 in step ST21 of FIG. 8.

When it is determined that the predetermined excavation operation has not been performed (NO in step ST31), the target specifier 56 terminates the current setting processing without setting a target value.

In contrast, when it is determined that the predetermined excavation operation has been performed (YES in step ST31), the target specifier 56 obtains the relationship between the excavation reactive force and the excavation weight (step ST32). The acquisition by the target specifier 56 is the same as the acquisition by the target specifier 56 in step ST22 of FIG. 8.

Thereafter, the target specifier 56 obtains a target weight (step ST33). In the illustrated example, the target specifier 56 recognizes the maximum loading capacity of the dump truck 200 based on the image of the dump truck 200 captured by the camera S6F as a space recognition device, and obtains the maximum loading capacity as the target weight. Specifically, the target specifier 56 recognizes the maximum loading capacity of the dump truck 200 by recognizing the size of a license plate, the size of the vehicle body, the height of the dump bed CB, a numerical value displayed on a maximum loading capacity sticker, or the like by using an image recognition technology. The target specifier 56 may receive information (information on the maximum loading capacity) transmitted from the dump truck 200 through the communicator T1, and obtain the maximum loading capacity as the target weight. The target weight may be a value input through the input device 42.

Thereafter, the target specifier 56 sets a target value (step ST34). In the illustrated example, the target specifier 56 sets a target value based on the relationship between the excavation reactive force and the excavation weight obtained in step ST32 and the target weight obtained in step ST33.

For example, when 1.0 tons of earth and sand is loaded on the dump bed CB of the dump truck 200 by the first excavation operation (first excavation operation) performed before the target value is set, the target specifier 56 determines that the dump bed CB of the dump truck 200 can be fully loaded by the subsequent nine excavation operations (second excavation operation). This is because 9.0 tons remain before the maximum loading amount of 10.0 tons is reached, and it can be estimated that 1.0 tons of earth and sand can be loaded on the dump bed CB by one excavation operation. That is, the target specifier 56 can derive a value (10 times) obtained by rounding up a quotient obtained by dividing the maximum loading amount (10.0 tons) by the excavation weight (1.0 tons) by the first excavation operation, as the number of excavation operation times (required number of times) required to achieve the target weight. The first excavation operation is the excavation operation performed before the target value is set, and the second excavation operation is the excavation operation performed after the target value is set. In this case, the target specifier 56 sets the maximum value of the excavation reactive force (maximum excavation reactive force) during the first excavation operation as the target value for each of the excavation operations from the second to the tenth. In each of the excavation operations from the second to the tenth, excavation is performed by the excavation reactive force of the same magnitude as that during the first excavation operation, and consequently, the excavation weight (1.0 tons) of the same magnitude as that during the first excavation operation is achieved. In this case, the weight of earth and sand loaded onto the dump truck 200 by the 10 excavation operations is 10.0 tons, as given by 1.0 tons×10 times. The weight of earth and sand already loaded onto the dump bed CB of the dump truck 200 by the first excavation operation (the first excavation operation) before the target value is set is the excavation weight by the first excavation operation (1.0 tons), and is also referred to as a "cumulative weight". The weight of earth and sand loaded onto the dump bed CB of the dump truck 200 by the second excavation operation (the excavation operations from the second to the tenth) after the target value is set is a value (9.0 tons) obtained by subtracting the cumulative weight from the maximum loading amount, and is also referred to as a "remaining weight".

As described above, the target specifier 56 may set the target value such that the maximum excavation reactive force equal to the maximum excavation reactive force when the first excavation operation is performed is achieved in the second excavation operation. Specifically, the target specifier 56 may set a target value such that earth and sand of the weight obtained by subtracting the cumulative weight from the target weight can be loaded onto the dump bed CB by the number of second excavation operation times obtained by subtracting the number of first excavation operation times already performed from the number of required operation times. The target specifier 56 may set a target value such that the weight of the earth and sand loaded onto the dump bed CB by each second excavation operation is substantially the same as the excavation weight during the first excavation operation. With this configuration, the target specifier 56 can operate the shovel 100 such that the excavation weight by each excavation operation is substantially the same.

Alternatively, when earth and sand of 1.2 tons is loaded onto the dump bed CB of the dump truck 200 by the first excavation operation (first excavation operation) performed before the target value is set, the target specifier 56 may determine that the dump bed CB of the dump truck 200 can be fully loaded by the subsequent eight excavation operations (second excavation operation). In this case, the target specifier 56 may set the maximum excavation reactive force during the first excavation operation as the target value for each of the second to eighth excavation operations. This is so that in each of the second to eighth excavation operations, excavation is performed by the excavation reactive force having the same magnitude as that during the first excavation operation, and the amount of the same excavation weight (1.2 tons) as that during the first excavation operation is achieved. The target specifier 56 may set a value corresponding to ⅓ of the maximum excavation reactive force during the first excavation operation as a target value for the ninth excavation operation. In the ninth excavation operation, excavation is performed by the excavation reactive force of ⅓ of that in the first excavation operation, and the excavation weight (0.6 tons) of ⅓ of that in the first excavation operation is achieved. That is, when the first excavation operation is completed, the target specifier 56 derives that the remaining required number of times is nine. The remaining weight, which is the weight of the earth and sand loaded onto the dump bed CB by the second excavation operation of eight times, is 8.8 tons in total of 1.2 tons×7 times and 0.4 tons×1 time. The remaining weight, together with the cumulative weight (1.2 tons×1 time), which is the weight loaded onto the dump bed CB by the first excavation operation of 1 time, becomes the target weight (10.0 tons).

Thus, the target specifier 56 may set the target value such that a maximum excavation reactive force equal to the maximum excavation reactive force when the first excavation operation is performed and a maximum excavation reactive force smaller than the maximum excavation reactive force are selectively realized in the second excavation operation. Specifically, the target specifier 56 may set the target value such that the earth and sand of the weight obtained by subtracting the cumulative weight from the target weight can be loaded onto the dump bed CB by the second excavation operation of the number of times obtained by subtracting the number of times of the first excavation operation already performed from the required number of times. The target specifier 56 may set the target value such that the excavation weight of as many times as possible becomes substantially the same as the excavation weight of the first excavation operation. With this configuration, the target specifier 56 can operate the shovel 100 such that the excavation weight of as many times as possible of the second excavation operation becomes substantially the same as the excavation weight of the first excavation operation. Then, the target specifier 56 can operate the shovel 100 such that the earth and sand corresponding to the target weight is loaded onto the dump bed CB.

Alternatively, the target specifier 56 may determine that when 1.2 tons of earth and sand are loaded onto the dump bed CB of the dump truck 200 by the first excavation operation (first excavation operation) performed before the target value is set, the dump bed CB of the dump truck 200 can be fully loaded by the subsequent eight excavation operations (second excavation operation). In this case, the target specifier 56 may set a value corresponding to about 92% of the maximum excavation reactive force during the first excavation operation as the target value for each of the second to ninth excavation operations. In each of the second to ninth excavation operations, excavation is performed by the excavation reactive force having a magnitude of about 92% of that during the first excavation operation, and an excavation weight (1.1 tons) having an amount of about 92% of that during the first excavation operation is achieved. That is, when the first excavation operation is completed, the target specifier 56 derives that the required number of times is nine. The remaining weight, which is the weight of the earth and sand loaded onto the dump bed CB by the second excavation operation of eight times, becomes 8.8 tons, as given by 1.1 tons×8 times. The remaining weight, together with the cumulative weight (1.2 tons×1 time), which is the weight loaded onto the dump bed CB by the first excavation operation of one time, becomes the target weight (10.0 tons).

In this way, the target specifier 56 may set the target value such that the maximum excavation reactive force smaller than the maximum excavation reactive force when the first excavation operation is performed is achieved in each second excavation operation. Specifically, the target specifier 56 may set the target value such that the earth and sand of the weight obtained by subtracting the cumulative weight from the target weight can be loaded onto the dump bed CB by the second excavation operation of the number of times obtained by subtracting the number of times of the first excavation operation already performed from the required number of times. Then, the target specifier 56 may set the target value such that the weight of the earth and sand loaded on the dump bed CB by the second excavation operation of each time becomes substantially the same. With this configuration, the target specifier 56 can operate the shovel 100 such that the excavation weight by the second excavation operation of each time becomes substantially the same. Then, the target specifier 56 can operate the shovel 100 such that the earth and sand corresponding to the target weight is loaded onto the dump bed CB.

Alternatively, when an average of 1.0 tons of earth and sand is loaded on the dump bed CB of the dump truck 200 by each of the three excavation operations (first excavation operation) performed before the target value is set, the target specifier 56 may determine that the dump bed CB of the dump truck 200 can be fully loaded by the subsequent seven excavation operations (second excavation operation). In this case, the target specifier 56 may set a value corresponding to the maximum average excavation reactive force of the three excavation operations as the target value for each of the fourth to tenth excavation operations. In each of the fourth to tenth excavation operations, excavation is performed by the excavation reactive force having the same magnitude as the maximum average excavation reactive force in the three first excavation operations, and the excavation weight (1.0 tons) having the same amount as the average excavation weight in the three first excavation operations is achieved. That is, when the third excavation operation is completed, the target specifier 56 derives that the remaining required number of times is eight. Then, the remaining weight, which is the weight of the earth and sand loaded onto the dump bed CB by the seven times of the second excavation operation, becomes 7.0 tons, as given by 1.0 tons×7 times. The remaining weight becomes the target weight (10.0 tons) together with the cumulative weight (3.0 tons), which is the weight loaded onto the dump bed CB by the three times of the first excavation operation.

As described above, the target specifier 56 may set the target value such that the maximum excavation reactive force smaller than the maximum average excavation reactive force of the plurality of first excavation operations is achieved in each second excavation operation. Specifically, the target specifier 56 may set the target value such that the earth and sand of the weight obtained by subtracting the cumulative weight from the target weight can be loaded onto the dump bed CB by the number of second excavation operation times obtained by subtracting the number of first excavation operation times already performed from the required number of times. The target specifier 56 may set the target value such that the weight of the earth and sand loaded onto the dump bed CB by each second excavation operation is substantially the same as the average excavation weight during the first excavation operation. With this configuration, the target specifier 56 can operate the shovel 100 such that the excavation weight by each second excavation operation is substantially the same as the average excavation weight during the first excavation operation. Then, the target specifier 56 can operate the shovel 100 such that the earth and sand corresponding to the target weight is loaded onto the dump bed CB.

In the above example, the target specifier 56 obtains the relationship between the excavation reactive force and the excavation weight as a linear relationship, but the relationship between the excavation reactive force and the excavation weight may be obtained as a nonlinear relationship.

In the above example, the target specifier 56 sets a value equal to or less than the excavation weight by one first excavation operation as the target value, but a value greater than the excavation weight by one first excavation operation may be set as the target value.

As described above, as illustrated in FIG. 1, the shovel 100 according to the embodiment of the present disclosure includes the lower traveling body 1, the upper swivel body 3 pivotably mounted on the lower traveling body 1, the attachment AT attached to the upper swivel body 3, and the controller 30 serving as a control device for repeatedly calculating the excavation reactive force based on information related to the excavation operation performed by the attachment AT with respect to the constructing object at the work site. The controller 30 sets a target value based on the excavation reactive force calculated during an excavation operation performed one or more times, and supports each excavation operation performed after the target value related to the excavation reactive force is set based on the target value related to the excavation reactive force.

The excavation operation performed one or more times to set the target value is an excavation operation for grasping the characteristics of the ground or the like to be excavated (hardness, viscosity, density, or relationship between excavation amount and excavation reactive force, etc.), and may be an excavation operation performed in response to the manual operation of the operation device 26 by the operator, excavation operations performed while being supported by the machine guidance function or the machine control function, or excavation operations performed automatically independent of the operation of the operation device 26.

The excavation operation performed one or more times to set the target value may be an excavation operation for test excavation performed first at one work site, an excavation operation performed at the first of each day at one work site, or an excavation operation performed whenever the characteristics of the excavation object change due to rainfall or the like. Therefore, the target value may be configured such that the operator can reset it by pressing a predetermined switch.

With this configuration, the controller 30 can enhance the working efficiency of the shovel 100. This is because the operator of the shovel 100 can match the excavation amount achieved by each excavation operation to a desired excavation amount. That is, the operator of the shovel 100 can achieve, for example, a state in which the bucket 6 is full of earth and sand immediately after each excavation operation.

The controller 30 may be configured to determine whether or not a predetermined excavation operation suitable for calculating the target value has been performed based on information on the excavation operation performed by the attachment AT for the constructing object at the work site, and to set the target value based on the excavation reactive force calculated during the excavation operation determined to be the predetermined excavation operation.

In the above example, the controller 30 determines whether or not the desired excavation amount has been achieved based on an image of the bucket 6 immediately after the excavation operation captured by the camera S6F, and when it is determined that the desired excavation amount has been achieved, it determines that the predetermined excavation operation has been performed. The controller 30 then sets the maximum value of the excavation reactive force calculated during the excavation operation determined to be the predetermined excavation operation as the target value.

With this configuration, the controller 30 can support the operation by the operator of the shovel 100 such that the maximum value of the excavation reactive force when each excavation operation after the target value has been set is equal to the maximum value of the excavation reactive force when each excavation operation before the target value has been set is performed. Therefore, the controller 30 can prevent the excavation amount due to each excavation operation after the target value has been set from being excessively varied. As a result, the controller 30 can enhance the working efficiency of the shovel 100.

The controller 30 may be configured to notify the operator that the current excavation reactive force has reached the target value in each excavation operation performed after the target value is set.

With this configuration, the operator of the shovel 100 can achieve a desired excavation amount by performing the boom-raising operation when receiving notification that the current excavation reactive force has reached the target value in each excavation operation.

The controller 30 may be configured to automatically operate a predetermined actuator when the current excavation reactive force has reached the target value, in each excavation operation performed after the target value is set.

With this configuration, the operator of the shovel 100 can achieve a desired excavation amount by simply performing an arm-closing operation without worrying about the timing of the boom-raising operation.

In each excavation operation performed after the target value is set, the controller 30 may be configured to automatically operate a predetermined actuator such that a point set at a predetermined portion of the attachment moves linearly until the current excavation reactive force reaches the target value.

With this configuration, the operator of the shovel 100 can execute the excavation operation by, for example, simply performing the arm-closing operation while pressing the MC switch after allowing the toe of the bucket 6 to enter the desired ground depth, and moving the toe horizontally such that the toe approaches the shovel 100 until the current excavation reactive force reaches the target value. When the current excavation reactive force reaches the target value, the excavation support function as described above is executed, such that the operator can achieve the desired excavation amount.

As illustrated in FIG. 5, the shovel 100 according to the embodiment of the present disclosure is a shovel for moving (loading) an object such as earth and sand to a predetermined place such as the dump bed CB of the dump truck 200 or the ground by repeating a series of operations including the excavation operation and the dumping operation, and is provided with the lower traveling body 1, the upper swivel body 3 pivotably mounted on the lower traveling body 1, the attachment AT attached to the upper swivel body 3, a sensor attached to the upper swivel body 3, and the controller 30 serving as a controller for calculating, based on the output of the sensor, an excavation reactive force generated by the excavation operation and an excavation weight (loading weight) which is the weight of the object taken into the bucket 6 and moved (loaded) to the predetermined place. The excavation weight is also referred to as "moving weight". The controller 30 sets a target value related to the excavation reactive force during the second excavation operation subsequently performed one or more times based on the relationship between the excavation reactive force calculated in first excavation operations performed one or more times and the excavation weight. The sensor includes at least one of an attitude sensor, a cylinder pressure sensor, or a space recognition device. The first excavation operation is performed before the target value is set, and the second excavation operation is performed after the target value is set.

This configuration brings about an effect that the weight of the object moved to the predetermined place can be calculated more accurately. For example, this configuration can derive the excavation weight more accurately than a case where the correspondence relationship between the excavation reactive force and the moving weight (excavation weight or loading weight) is not used. This is because the excavation reactive force is not affected by disturbances generated when the bucket 6 is lifted in the air.

This configuration also brings about an effect that the weight (moving weight) of the object, such as earth and sand, moved to the predetermined place by each second excavation operation performed after the target value is set can be controlled. Therefore, this configuration can suppress the moving weight in each of a plurality of second excavation operations from being greatly varied.

The shovel 100 operates such that the weight of the object moved to the predetermined place becomes the target weight by repeating a series of operations including the excavation operation and the dumping operation. The controller 30 may be configured to set a target value related to the excavation reactive force during the second excavation operation based on the relationship between the excavation reactive force and the excavation weight calculated during the first excavation operation, the cumulative weight that is the weight of the object already moved to the predetermined place, and the target weight.

This configuration brings about an effect that the moving weight by each second excavation operation can be controlled such that the moving weight by the second excavation operation subsequently performed one or more times after the target value is set does not exceed the remaining weight, which is the difference between the target weight and the cumulative weight.

Furthermore, the controller 30 may be configured to calculate the number of excavation operation times (required number of times) necessary for the weight of an object moved to a predetermined place to reach the target weight based on the relationship between the excavation reactive force and the excavation weight calculated during the first excavation operation, the cumulative weight, and the target weight, and to set a target value related to the excavation reactive force during the second excavation operation based on the number of excavation operation times.

This configuration brings about an effect that the moving weight by each second excavation operation can be controlled such that the moving weight by the second excavation operation subsequently performed one or more times after the target value is set becomes the weight obtained by dividing the remaining weight by the required number of times. Therefore, this configuration can prevent the moving weight by the second excavation operation of a certain time from becoming extremely large or small, and consequently can improve fuel efficiency of the shovel 100.

As illustrated in FIG. 5, the shovel 100 according to the embodiment of the present disclosure is a shovel that operates such that the weight of an object, such as earth and sand, moved to a predetermined place such as the dump bed CB of the dump truck 200 or the ground becomes the target weight by repeating a series of operations including the excavation operation and the dumping operation, and is provided with the lower traveling body 1, the upper swivel body 3 pivotably mounted on the lower traveling body 1, the attachment AT attached to the upper swivel body 3, a sensor attached to the upper swivel body 3, and the controller 30 serving as a controller for calculating the excavation reactive force generated by the excavation operation and the excavation weight as the weight of the object taken into the bucket 6 based on the output of the sensor. The controller 30 sets a target value related to the excavation reactive force during the second excavation operation subsequently performed one or more times based on the relationship between the excavation reactive force and the excavation weight calculated during the first excavation operation performed one or more times and the target weight.

This configuration brings about an effect that the weight of the object moved to the predetermined place and the target weight can be easily matched. This is because the target value related to the excavation reactive force is set such that the weight of the object moved to the predetermined place and the target weight match with each other when the maximum excavation reactive force corresponding to the target value is achieved in each second excavation operation.

When the excavation reactive force or the excavation weight calculated during the first excavation operation is an abnormal value, the controller 30 may be configured to set a target value related to the excavation reactive force during the second excavation operation based on a relationship between the excavation reactive force and the excavation weight calculated during excavation operation performed one or more times before the first excavation operation and the target weight. The excavation reactive force is determined to be an abnormal value when, for example, it exceeds a range between a preset upper limit value and a preset lower limit value. The same applies to the excavation weight. In this case, for example, when it is determined that the excavation reactive force calculated during the third first excavation operation among the three first excavation operations is an abnormal value, the controller 30 sets a target value related to the excavation reactive force during the second excavation operation based on the relationship between the excavation reactive force and the excavation weight calculated during the first and second first excavation operations and the target weight.

This configuration can suppress setting of a target value based on an abnormal value. Therefore, this configuration brings about an effect that the weight of the object moved to a predetermined place can be more accurately calculated.

The controller 30 may be configured to notify the operator that the current excavation reactive force has reached the target value in each second excavation operation performed after the target value is set. For example, the controller 30 can notify the operator that the current excavation reactive force has reached the target value through the display device 40, the sound output device 43, or the like. In this case, the operator who recognizes that the current excavation reactive force has reached the target value performs the boom-raising operation at that point to raise the boom 4 and lift the bucket 6, which is at least partially underground, into the air, thereby achieving the excavation weight (loading weight) corresponding to the target value related to the excavation reactive force.

Therefore, this configuration brings about an effect that the weight of the object moved to a predetermined place and the target weight can be easily matched. This is because, for the excavation weight in each second excavation operation, the excavation weight (target excavation weight) corresponding to the target value (excavation reactive force) is achieved when the boom-raising operation is performed upon generation of the excavation reactive force corresponding to the target value, and the difference between the target excavation weight and the actual excavation weight increases, as the excavation reactive force when the boom-raising operation is performed deviates from the target value.

In addition, the controller 30 may be configured to automatically operate a predetermined actuator when the current excavation reactive force reaches the target value in each second excavation operation performed after the target value is set. For example, the controller 30 (automation controller 54) can automatically adjust the pilot pressure acting on the pilot port of the control valve corresponding to the boom cylinder 7. Thus, the controller 30 (automation controller 54) can raise the boom 4 and lift the bucket 6, which is at least partially underground, into the air, thereby achieving the excavation weight (loading weight) corresponding to the target value related to the excavation reactive force.

Therefore, this arrangement brings about an effect that the weight of the object moved to a predetermined place can be more easily matched with the target weight. This is because the boom 4 can be raised at a more appropriate timing than when the boom-raising operation is performed by manual operation.

The shovel described above can more accurately calculate the weight of an object moved to a predetermined place.

The preferred embodiment of the present invention has been described in detail. However, the present invention is not limited to the embodiment described above, nor to the embodiment described in the following. Various variations, substitutions, and the like may be applied to the embodiment described above or described in the following without departing from the scope of the present invention. Also, the separately described features may be combined as long as no technical conflict arises.

For example, the shovel 100 may be a remotely operated shovel. In this case, the controller 30 may be a controller installed in a remote-control room located outside the shovel 100. The shovel 100 may also be an autonomous shovel that does not require operation by an operator.

What is claimed is:

1. A shovel configured to move an object to a predetermined place by repeating a series of operations including an excavation operation and a dumping operation, the shovel comprising:

a lower traveling body;

an upper swivel body pivotably mounted on the lower traveling body;

an attachment attached to the upper swivel body;

a sensor attached to the upper swivel body; and a hardware processor configured to calculate, based on an output of the sensor, an excavation reactive force generated by the excavation operation and an excavation weight, the excavation weight being a weight of an object taken into a bucket by the excavation operation and moved to the predetermined place, obtain a relationship between the excavation reactive force and the excavation weight calculated during a first excavation operation performed one or more times, derive a value of the excavation reactive force corresponding to a desired value of the excavation weight from the obtained relationship, and set the derived value of the excavation reactive force as a target value for the excavation reactive force during a second excavation operation performed one or more times subsequent to the first excavation operation.

2. The shovel according to claim 1, wherein the shovel is configured to operate such that the weight of the object moved to the predetermined place becomes a target weight by repeating the series of operations including the excavation operation and a dumping operation, and the hardware processor is further configured to derive the value of the excavation reactive force corresponding to the desired value of the excavation weight based on the obtained relationship, the target weight, and a cumulative weight of the object already moved to the predetermined place.

3. The shovel according to claim 2, wherein the hardware processor is further configured to calculate a number of excavation operation times necessary for the weight of the object moved to the predetermined place to reach the target weight based on the obtained relationship, the cumulative weight, and the target weight, and derive the value of the excavation reactive force corresponding to the desired value of the excavation weight based on the number of excavation operation times.

4. A shovel configured to operate such that a weight of an object moved to a predetermined place becomes a target weight by repeating a series of operations including an excavation operation and a dumping operation, the shovel comprising:

a lower traveling body;

an upper swivel body pivotably mounted on the lower traveling body;

an attachment attached to the upper swivel body;

a sensor attached to the upper swivel body; and a hardware processor configured to calculate, based on an output of the sensor, an excavation reactive force generated by the excavation operation and an excavation weight, the excavation weight being a weight of an object taken into a bucket by the excavation operation and moved to the predetermined place, obtain a relationship between the excavation reactive force and the excavation weight calculated during a first excavation operation performed one or more times, derive a value of the excavation reactive force corresponding to a desired value of the excavation weight from the obtained relationship and the target weight, and set the derived value of the excavation reactive force as a target value for the excavation reactive force during a second excavation operation performed one or more times subsequent to the first excavation operation.

5. The shovel according to claim 4, wherein the hardware processor is further configured to, in response to determining that the excavation reactive force or the excavation weight calculated during the first excavation operation is an abnormal value, derive the value of the excavation reactive force corresponding to the desired value of the excavation weight from the target weight and a relationship between the excavation reactive force and the excavation weight calculated during the excavation operation performed one or more times before the first excavation operation.

6. The shovel according to claim 1, wherein the hardware processor is further configured to notify an operator that a current excavation reactive force has reached the target value in each of the one or more times of the second excavation operation performed after the derived value of the excavation reactive force is set as the target value.

7. The shovel according to claim 1, wherein the hardware processor is further configured to automatically operate a predetermined actuator upon a current excavation reactive force reaching the target value in each of the one or more times of the second excavation operation performed after the derived value of the excavation reactive force is set as the target value.

8. The shovel according to claim 1, wherein the hardware processor is further configured to determine whether an excavation operation satisfying a predetermined condition has been performed during the one or more times of the first excavation operation, and obtain the relationship between the excavation reactive force and the excavation weight calculated during the first excavation operation performed one or more times in response to determining that the excavation operation satisfying the predetermined condition has been performed during the one or more times of the first excavation operation.

9. The shovel according to claim 8, wherein the hardware processor is further configured not to obtain the relationship between the excavation reactive force and the excavation weight calculated during the first excavation operation performed one or more times in response to determining that the excavation operation satisfying the predetermined condition has not been performed during the one or more times of the first excavation operation.

10. The shovel according to claim 8, wherein the hardware processor is further configured to determine that the excavation operation satisfying the predetermined condition has been performed in response to determining that an amount of the object taken into the bucket is greater than a predetermined amount.

11. The shovel according to claim 10, wherein the predetermined amount is less than a capacity of the bucket.

12. The shovel according to claim 8, wherein the hardware processor is further configured to determine that the excavation operation satisfying the predetermined condition has been performed in response to determining that an operator of the shovel has determined that the excavation operation satisfying the predetermined condition has been performed.

13. The shovel according to claim 12, wherein the hardware processor is further configured to determine that the operator of the shovel has determined that the excavation operation satisfying the predetermined condition has been performed, in response to the operator pressing a predetermined button.

14. The shovel according to claim 4, wherein the hardware processor is further configured to determine whether an excavation operation satisfying a predetermined condition has been performed during the one or more times of the first excavation operation, and obtain the relationship between the excavation reactive force and the excavation weight calculated during the first excavation operation performed one or more times in response to determining that the excavation operation satisfying the predetermined condition has been performed during the one or more times of the first excavation operation.

15. The shovel according to claim 14, wherein the hardware processor is further configured not to obtain the relationship between the excavation reactive force and the excavation weight calculated during the first excavation operation performed one or more times in response to determining that the excavation operation satisfying the predetermined condition has not been performed during the one or more times of the first excavation operation.

16. The shovel according to claim 14, wherein the hardware processor is further configured to determine that the excavation operation satisfying the predetermined condition has been performed in response to determining that an amount of the object taken into the bucket is greater than a predetermined amount.

17. The shovel according to claim 16, wherein the predetermined amount is less than a capacity of the bucket.

18. The shovel according to claim 14, wherein the hardware processor is further configured to determine that the excavation operation satisfying the predetermined condition has been performed in response to determining that an operator of the shovel has determined that the excavation operation satisfying the predetermined condition has been performed.

19. The shovel according to claim 18, wherein the hardware processor is further configured to determine that the operator of the shovel has determined that the excavation operation satisfying the predetermined condition has been performed, in response to the operator pressing a predetermined button.

* * * * *